US008276514B2

(12) United States Patent
Fink et al.

(10) Patent No.: US 8,276,514 B2
(45) **Date of Patent: *Oct. 2, 2012**

(54) METAL FIXING MATERIAL BUSHING AND METHOD FOR PRODUCING A BASE PLATE OF A METAL FIXING MATERIAL BUSHING

(75) Inventors: Thomas Fink, Landshut (DE); Neil Heeke, Golden, CO (US); Adolf Olzinger, Ergolding (DE); Thomas Pfeiffer, Kumhausen (DE); Reinhard Ranftl, Pfeffenhausen (DE); Richard Bender, Lauf (DE); Bartholomäus Forster, Essenbach-Oberahain (DE)

(73) Assignee: Schott AG, Mainz (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/788,624

(22) Filed: May 27, 2010

(65) Prior Publication Data

US 2010/0229616 A1 Sep. 16, 2010

Related U.S. Application Data

(60) Division of application No. 12/098,616, filed on Apr. 7, 2008, which is a continuation-in-part of application No. 11/627,173, filed on Jan. 25, 2007, now Pat. No. 8,127,681, which is a continuation-in-part of application No. 10/791,165, filed on Mar. 2, 2004, now abandoned.

(30) Foreign Application Priority Data

| | | |
|---|---|---|
| Mar. 3, 2003 | (DE) | 203 03 413 |
| Mar. 10, 2003 | (DE) | 103 21 067 |
| Jun. 11, 2003 | (DE) | 103 26 253 |
| Sep. 20, 2003 | (DE) | 203 14 580 |
| Jan. 27, 2006 | (DE) | 10 2006 004 036 |

(51) Int. Cl.
*F42C 11/00* (2006.01)

(52) U.S. Cl. ..... 102/202.9; 102/202.5; 102/202.7; 102/202.12; 174/152 GM; 65/59.1; 65/59.6; 65/59.31

(58) Field of Classification Search ..... 72/334–336, 72/338, 329; 83/55, 39, 40, 686; 102/202.8, 102/202.5, 202.7, 202.12, 202.9; 174/152 GM; 65/59.1, 59.31, 59.34, 59.35, 59.4, 59.6
See application file for complete search history.

(56) References Cited

U.S. PATENT DOCUMENTS 1,325,194 A 12/1919 Geist (Continued)

FOREIGN PATENT DOCUMENTS

CA 2 459 262 9/2004

(Continued)

OTHER PUBLICATIONS

Communication dated Aug. 6, 2010 from European Patent Office for EP 10 002 045.2-1260, including European Search Report dated Jul. 30, 2010 and opinion (7 pages).
Communication dated Jun. 1, 2011 from European Patent Office for EP 10 002 045.2-1260 (4 pages).
Communication dated Oct. 17, 2011 from European Patent Office for EP 10 009 062.0-1260, including European Search Report dated Oct. 6, 2011 and opinion (8 pages).

(Continued)

*Primary Examiner* — Daniel Troy
(74) *Attorney, Agent, or Firm* — Taylor IP, P.C.

(57) ABSTRACT

A glass-to-metal bushing for ignitors of airbags or belt tensioning pulleys. A metal pin is arranged in a slot in the base plate in the fixing material, the base plate being formed by one element whereby the base geometry describing the slot is produced by at least one separation process. Structure is provided between the front and rear of the base plate for preventing relative motion of the fixing material in the direction of the base plate rear portion across from the inner circumference of the slot.

14 Claims, 13 Drawing Sheets

U.S. PATENT DOCUMENTS

| | | | | | |
|---|---|---|---|---|---|
| 1,584,998 | A | | 5/1926 | Symons et al. | |
| 1,813,906 | A | | 6/1928 | Caron | |
| 3,134,329 | A | | 5/1964 | Zeman | |
| 3,274,937 | A | | 9/1966 | Kyle | |
| 3,635,067 | A | * | 1/1972 | Hanas | 72/329 |
| 3,735,664 | A | | 5/1973 | Hermle | |
| 3,735,705 | A | | 5/1973 | Hudson, Jr. et al. | |
| 3,971,320 | A | | 7/1976 | Lee | |
| 4,048,835 | A | | 9/1977 | Giger | |
| 4,453,033 | A | | 6/1984 | Duff et al. | |
| 4,566,892 | A | | 1/1986 | Ertel | |
| 4,577,646 | A | | 3/1986 | Ziehn | |
| 4,686,903 | A | | 8/1987 | Wittwer | |
| 4,800,745 | A | | 1/1989 | Yokoyama | |
| 5,016,461 | A | * | 5/1991 | Walker et al. | 72/336 |
| 5,140,906 | A | | 8/1992 | Little, II | |
| 5,157,831 | A | | 10/1992 | Wang et al. | |
| 5,243,492 | A | * | 9/1993 | Marquit et al. | 361/247 |
| 5,345,872 | A | | 9/1994 | Takahashi et al. | |
| 5,404,263 | A | | 4/1995 | Graves et al. | |
| 5,621,183 | A | | 4/1997 | Bailey | |
| 5,672,841 | A | | 9/1997 | Monk et al. | |
| 5,709,724 | A | | 1/1998 | Naugler et al. | |
| 5,732,634 | A | * | 3/1998 | Flickinger et al. | 102/202.5 |
| 5,943,897 | A | | 8/1999 | Tsue et al. | |
| 5,988,069 | A | | 11/1999 | Bailey | |
| 6,026,721 | A | | 2/2000 | Fukai | |
| 6,274,252 | B1 | | 8/2001 | Naugler et al. | |
| D460,684 | S | | 7/2002 | Liao | |
| 6,557,474 | B1 | | 5/2003 | Morte et al. | |
| 6,612,241 | B2 | | 9/2003 | Avetisian | |
| 6,755,670 | B2 | | 6/2004 | Korber | |
| 6,877,431 | B2 | | 4/2005 | Heeke | |
| 6,936,303 | B1 | * | 8/2005 | Katsuda et al. | 427/117 |
| D528,407 | S | | 9/2006 | Schwab | |
| 7,124,688 | B2 | | 10/2006 | Avetisian et al. | |
| 7,267,056 | B2 | | 9/2007 | Takahara et al. | |
| 7,770,520 | B2 | | 8/2010 | Fink et al. | |
| 7,975,611 | B2 | | 7/2011 | Bjoern | |
| 2002/0069781 | A1 | * | 6/2002 | Avetisian et al. | 102/202.7 |
| 2002/0069783 | A1 | | 6/2002 | Avetisian et al. | |
| 2002/0081899 | A1 | | 6/2002 | Korber | |
| 2002/0174792 | A1 | | 11/2002 | Kubozuka et al. | |
| 2003/0177936 | A1 | * | 9/2003 | Luebbers | 102/530 |
| 2003/0192446 | A1 | | 10/2003 | Berg et al. | |
| 2004/0079545 | A1 | | 4/2004 | Heeke | |
| 2004/0216631 | A1 | | 11/2004 | Fink et al. | |
| 2004/0250542 | A1 | | 12/2004 | Nishina | |
| 2005/0051435 | A1 | | 3/2005 | Forster et al. | |
| 2005/0126415 | A1 | | 6/2005 | Takahara et al. | |
| 2006/0207469 | A1 | | 9/2006 | Fink et al. | |
| 2006/0222881 | A1 | | 10/2006 | Fink et al. | |
| 2007/0187934 | A1 | | 8/2007 | Fink | |
| 2008/0245545 | A1 | | 10/2008 | Bjorn | |
| 2009/0044715 | A1 | | 2/2009 | Hartl et al. | |
| 2009/0158953 | A1 | | 6/2009 | Magne et al. | |
| 2010/0199872 | A1 | | 8/2010 | Fink et al. | |

FOREIGN PATENT DOCUMENTS

| | | | |
|---|---|---|---|
| CN | 100393555 | C | 6/2011 |
| DE | 29 04 174 | | 8/1980 |
| DE | 34 14 625 | | 10/1984 |
| DE | 34 15 625 | A1 | 10/1985 |
| DE | 198 35 478 | A1 | 2/2000 |
| DE | 199 27 233 | | 1/2001 |
| DE | 101 33 223 | | 10/2002 |
| DE | 103 48 944 | | 5/2004 |
| DE | 203 14 580 | | 8/2004 |
| DE | 10 2005 009 644 | A1 | 9/2006 |
| DE | 10 2007 016 692 | B3 | 7/2008 |
| EP | 0 137 488 | A2 | 4/1985 |
| EP | 0 064 263 | B1 | 7/1986 |
| EP | 0 248 977 | | 12/1987 |
| EP | 0 248 977 | B1 | 1/1992 |
| EP | 0 610 925 | A1 | 8/1994 |
| EP | 1 061 325 | A1 | 12/2000 |
| EP | 1 130 697 | A2 | 9/2001 |
| EP | 1 225 415 | | 7/2002 |
| EP | 1 061 325 | B1 | 1/2003 |
| EP | 1 455 160 | | 9/2004 |
| EP | 1 491 848 | | 12/2004 |
| EP | 1 808 667 | A2 | 7/2007 |
| EP | 1 455 160 | B1 | 5/2008 |
| EP | 2 251 633 | A2 | 11/2010 |
| EP | 1 813 906 | B1 | 4/2011 |
| JP | 60-105829 | A | 6/1985 |
| JP | 3-5753 | U | 1/1991 |
| JP | 5-256596 | A | 10/1993 |
| JP | 3058511 | U | 3/1999 |
| JP | 2000-500856 | A | 1/2000 |
| JP | 2000-111297 | A | 4/2000 |
| JP | 2001-518439 | A | 10/2001 |
| JP | 2003-285712 | A | 10/2003 |
| WO | 99/16721 | A1 | 4/1999 |
| WO | 03/083404 | A1 | 10/2003 |
| WO | 2007/054530 | A1 | 5/2007 |

OTHER PUBLICATIONS

Communication dated Oct. 17, 2011 from European Patent Office for EP 10 009 095.0-1260, including European Search Report dated Oct. 7, 2011 and opinion (8 pages).
Opposition documents Dated Feb. 3, 2009 filed in European Patent Office in EP 1 455 160 B1, including documents E5-E13 (52 pages).
Communication dated Jun. 11, 2004 from European Patent Office for EP 04002670.0-1260, including European Search Report dated May 21, 2004 (4 pages).
Communication dated Jun. 8, 2005 from European Patent Office for EP 04002670.0-1260 (10 pages).
Communication dated Jul. 24, 2009 submitted in EP 04002670.0, including document E14 (10 pages).
Communication dated Oct. 28, 2009 submitted in EP 04002670.0, including documents E6.1-E7.1 (12 pages).
Communication dated Oct. 12, 2010 from European Patent Office in EP 04002670.0 (3 pages).
Document dated Jan. 26, 2009 and signed by Sabine Sibera (4 pages).
Communication dated Jan. 21, 2011 submitted in EP 04002670.0, including documents E14-E25 (33 pages).
Communication dated Oct. 7, 2011 from European Patent Office in EP 04002670.0 (2 pages).
Communication dated Mar. 2, 2011 from European Patent Office in EP 04002670.0 (1 page).
Transcript in opposition in EP 04002670.0 (EP 1455160)(41 pages).
Documents filed Jun. 30, 2011 in European Patent Office in EP 04 002 670.0-1260 (28 pages).
Declaration of Mr. Thomas Fink dated May 9, 2011 submitted in U.S. Appl. No. 12/098,616 (2 pages).
Declaration of Mr. Thomas Fink dated Sep. 19, 2011 submitted in U.S. Appl. No. 12/788,624 (4 pages).
Declaration of Mr. Thomas Fink dated May 2, 2011 submitted in U.S. Appl. No. 12/098,616 (4 pages).
Declaration of Dr. Michael Sawodny dated Feb. 28, 2011 in U.S. Appl. No. 11/627,173, with Appendixes A-F (88 pages).
Declaration of Dr. Michael Sawodny dated Mar. 21, 2011 in U.S. Appl. No. 11/627,173, with Corrected Appendix E (9 pages).
Declaration of Mr. Thomas Fink dated Feb. 28, 2011 in U.S. Appl. No. 11/627,173, with Appendixes A-B (7 pages).
Gestaltungsregein für Stanzteile aus Stahl; DIN 6932; Jan. 1983; pp. 61-65 (5 pages).
Begriffe der Stanztechnik Fertigungsverfahren und Werkzeuge zum Zerteilen; DIN 9870; Oct. 1972; pp. 306-307 and 300-302 (6 pages).
Documents filed in appeal in European Patent Office on Oct. 25, 2011 for EP 1 455 160 (Application No. EP 04002670.0)(166 pages).
Documents filed in opposition in European Patent Office on Jan. 19, 2012 (appears to have filed only in part on Jan. 18, 2012) for European Patent No. EP 1 813 906 (168 pages).
Communication from Japanese Patent Office (dated Jan. 16, 2012) in Japanese Patent Application No. 2009-270630 (3 pages).

* cited by examiner

Fig.1a
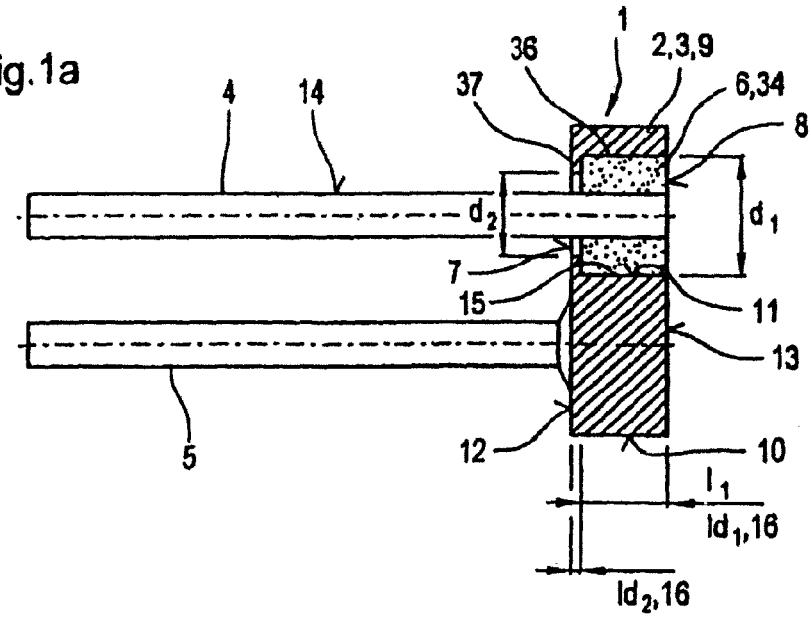
Fig.1b
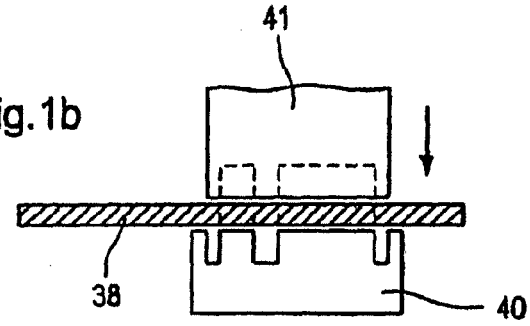
Fig.1c
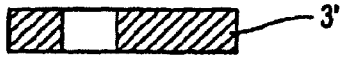
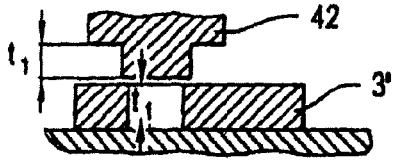
Fig.1d
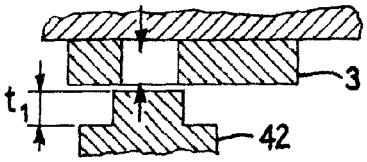
Fig.1f
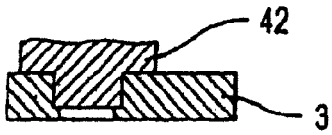
Fig.1e

Fig. 13

Table 1

| Ratio Thickness/Hole diameter | Thickness after grinding [in mm] | | | | | | | | | | |
|---|---|---|---|---|---|---|---|---|---|---|---|
| Hole diameter [in mm] | 2 | 2,1 | 2,2 | 2,3 | 2,4 | 2,5 | 2,6 | 2,7 | 2,8 | 2,9 | 3 |
| 1,6 | 1,3 | 1,3 | 1,4 | 1,4 | 1,5 | 1,6 | 1,6 | 1,7 | 1,8 | 1,8 | 1,9 |
| 1,7 | 1,2 | 1,2 | 1,3 | 1,4 | 1,4 | 1,5 | 1,5 | 1,6 | 1,6 | 1,7 | 1,8 |
| 1,8 | 1,1 | 1,2 | 1,2 | 1,3 | 1,3 | 1,4 | 1,4 | 1,5 | 1,6 | 1,6 | 1,7 |
| 1,9 | 1,1 | 1,1 | 1,2 | 1,2 | 1,3 | 1,3 | 1,4 | 1,4 | 1,5 | 1,5 | 1,6 |
| 2 | 1 | 1,1 | 1,1 | 1,2 | 1,2 | 1,3 | 1,3 | 1,4 | 1,4 | 1,5 | 1,5 |
| 2,1 | 1 | 1 | 1 | 1,1 | 1,1 | 1,2 | 1,2 | 1,3 | 1,3 | 1,4 | 1,4 |
| 2,2 | 0,9 | 1 | 1 | 1 | 1,1 | 1,1 | 1,2 | 1,2 | 1,3 | 1,3 | 1,4 |
| 2,3 | 0,9 | 0,9 | 1 | 1 | 1 | 1,1 | 1,1 | 1,2 | 1,2 | 1,3 | 1,3 |
| 2,4 | 0,8 | 0,9 | 0,9 | 1 | 1 | 1 | 1,1 | 1,1 | 1,2 | 1,2 | 1,3 |
| 2,5 | 0,8 | 0,8 | 0,9 | 0,9 | 1 | 1 | 1 | 1,1 | 1,1 | 1,2 | 1,2 |
| 2,6 | 0,8 | 0,8 | 0,8 | 0,9 | 0,9 | 1 | 1 | 1 | 1,1 | 1,1 | 1,2 |
| 2,7 | 0,7 | 0,8 | 0,8 | 0,9 | 0,9 | 0,9 | 1 | 1 | 1 | 1,1 | 1,1 |
| 2,8 | 0,7 | 0,8 | 0,8 | 0,8 | 0,9 | 0,9 | 0,9 | 1 | 1 | 1 | 1,1 |
| 2,9 | 0,7 | 0,7 | 0,8 | 0,8 | 0,8 | 0,9 | 0,9 | 0,9 | 1 | 1 | 1 |
| 3,0 | 0,7 | 0,7 | 0,7 | 0,8 | 0,8 | 0,8 | 0,9 | 0,9 | 0,9 | 1 | 1 |
| 3,1 | 0,6 | 0,7 | 0,7 | 0,7 | 0,8 | 0,8 | 0,8 | 0,9 | 0,9 | 0,9 | 1 |
| 3,2 | 0,6 | 0,7 | 0,7 | 0,7 | 0,8 | 0,8 | 0,8 | 0,8 | 0,9 | 0,9 | 0,9 |
| 3,3 | 0,6 | 0,6 | 0,7 | 0,7 | 0,7 | 0,8 | 0,8 | 0,8 | 0,8 | 0,9 | 0,9 |
| 3,4 | 0,6 | 0,6 | 0,6 | 0,7 | 0,7 | 0,7 | 0,8 | 0,8 | 0,8 | 0,9 | 0,9 |
| 3,5 | 0,6 | 0,6 | 0,6 | 0,7 | 0,7 | 0,7 | 0,7 | 0,8 | 0,8 | 0,8 | 0,9 |

1000

1100

Fig. 14

Table 2

| Ratio Thickness/Hole diameter | Thickness after stamping/before grinding [in mm] | | | | | | | | | | |
|---|---|---|---|---|---|---|---|---|---|---|---|
| Hole diameter [in mm] | 2,4 | 2,5 | 2,6 | 2,7 | 2,8 | 2,9 | 3 | 3,1 | 3,2 | 3,3 | 3,4 |
| 1,6 | 1,5 | 1,6 | 1,6 | 1,7 | 1,8 | 1,8 | 1,9 | 1,9 | 2 | 2,1 | 2,1 |
| 1,7 | 1,4 | 1,5 | 1,5 | 1,6 | 1,6 | 1,7 | 1,8 | 1,8 | 1,9 | 1,9 | 2 |
| 1,8 | 1,3 | 1,4 | 1,4 | 1,5 | 1,6 | 1,6 | 1,7 | 1,7 | 1,8 | 1,8 | 1,9 |
| 1,9 | 1,3 | 1,3 | 1,4 | 1,4 | 1,5 | 1,5 | 1,6 | 1,6 | 1,7 | 1,7 | 1,8 |
| 2 | 1,2 | 1,3 | 1,3 | 1,4 | 1,4 | 1,5 | 1,5 | 1,6 | 1,6 | 1,7 | 1,7 |
| 2,1 | 1,1 | 1,2 | 1,2 | 1,3 | 1,3 | 1,4 | 1,4 | 1,5 | 1,5 | 1,6 | 1,6 |
| 2,2 | 1,1 | 1,1 | 1,2 | 1,2 | 1,3 | 1,3 | 1,4 | 1,4 | 1,5 | 1,5 | 1,5 |
| 2,3 | 1 | 1,1 | 1,1 | 1,2 | 1,2 | 1,3 | 1,3 | 1,3 | 1,4 | 1,4 | 1,5 |
| 2,4 | 1 | 1 | 1,1 | 1,1 | 1,2 | 1,2 | 1,3 | 1,3 | 1,3 | 1,4 | 1,4 |
| 2,5 | 1 | 1 | 1 | 1,1 | 1,1 | 1,2 | 1,2 | 1,2 | 1,3 | 1,3 | 1,4 |
| 2,6 | 0,9 | 1 | 1 | 1 | 1,1 | 1,1 | 1,2 | 1,2 | 1,2 | 1,3 | 1,3 |
| 2,7 | 0,9 | 0,9 | 1 | 1 | 1 | 1,1 | 1,1 | 1,1 | 1,2 | 1,2 | 1,3 |
| 2,8 | 0,9 | 0,9 | 0,9 | 1 | 1 | 1 | 1,1 | 1,1 | 1,1 | 1,2 | 1,2 |
| 2,9 | 0,8 | 0,9 | 0,9 | 0,9 | 1 | 1 | 1 | 1,1 | 1,1 | 1,1 | 1,2 |
| 3,0 | 0,8 | 0,8 | 0,9 | 0,9 | 0,9 | 1 | 1 | 1 | 1,1 | 1,1 | 1,1 |
| 3,1 | 0,8 | 0,8 | 0,8 | 0,9 | 0,9 | 0,9 | 1 | 1 | 1 | 1,1 | 1,1 |
| 3,2 | 0,8 | 0,8 | 0,8 | 0,8 | 0,9 | 0,9 | 0,9 | 1 | 1 | 1 | 1,1 |
| 3,3 | 0,7 | 0,8 | 0,8 | 0,8 | 0,8 | 0,9 | 0,9 | 0,9 | 1 | 1 | 1 |
| 3,4 | 0,7 | 0,7 | 0,8 | 0,8 | 0,8 | 0,9 | 0,9 | 0,9 | 0,9 | 1 | 1 |
| 3,5 | 0,7 | 0,7 | 0,7 | 0,8 | 0,8 | 0,8 | 0,9 | 0,9 | 0,9 | 0,9 | 1 |

1000

1100

METAL FIXING MATERIAL BUSHING AND METHOD FOR PRODUCING A BASE PLATE OF A METAL FIXING MATERIAL BUSHING

CROSS-REFERENCE TO RELATED APPLICATION

This application is a divisional of U.S. patent application Ser. No. 12/098,616, filed Apr. 7, 2008, which is a continuation-in-part of U.S. application Ser. No. 10/791,165 filed Mar. 2, 2004, and a continuation-in-part of U.S. application Ser. No. 11/627,173, filed Jan. 25, 2007. The contents of these applications are incorporated herein by reference. Furthermore the application claims priority of German Utility Application No. DE 203 03 413.9 filed Mar. 3, 2003, German Patent Application No. 103 26 253.9 filed Jun. 11, 2003, and German Patent Application No. 10 2006 004 036.8, filed Jan. 27, 2006. The content of these applications are also incorporated by reference.

BACKGROUND OF THE INVENTION

The invention relates to a metal fixing material bushing.

Metal fixing material bushings are in the state of the art in various designs. By metal fixing material bushings, vacuum-tight sealings of fixing materials are understood, in particular sealings of glasses to metals. The metals act as electric conductors. As representatives, reference is made to U.S. Pat. Nos. 5,345,872 and 3,274,937. Such bushings are common in electronics and in electrical engineering. The glass used for sealing serves as an insulator. Typical metal fixing material bushings are built in such a way, that metallic inner conductors are sealed in a preformed sintered glass part, whereby the sintered glass part or the glass tube in an outer metal part is sealed with the so-called base plate. For example, igniters are preferred applications of such metal fixing material bushings. Said igniters are used among other things for airbags or belt tensioning pulleys in motor vehicles. In this case the metal fixing material bushings are components of an ignition device. In addition to the metal fixing material bushing, the entire ignition device comprises a spark gap, the explosive metal cover, which tightly encapsulates the ignition mechanism. Either one or two or more than two metallic pins can be passed through the bushing. In a preferred implementation with one metallic pin the casing is grounded, in a preferred two-pole embodiment it grounded to one of the pins. The previously described ignition device is used in particular for air bags or belt tensioning pulleys in motor vehicles. Known devices of the named or similar type are described in U.S. Pat. Nos. 6,274,252, 5,621,183, DE 29 04 174 A1 or DE 199 27 233 A1, whose disclosure content is fully included in the present application. The previously named ignition units have two metal pins. However, electronic ignition devices are also possible with only a single pin. The ignition devices shown in the state of the art comprise a metal base plate, for example a metal sleeve, which is constructed as a swivel part. The metal base plate exhibits at least one opening through which at least one metal pin is passed. One significant problem of this design consists in the fact that such a design is both material and cost-intensive.

The invention is therefore based on the object of creating a metal fixing material bushing of the initially named type in such a way that it is characterized by a high strength with low material and labor expenses and by a suitability for higher stresses and further that assembly errors, which result from the inaccurate correspondence of the individual elements, are avoided.

SUMMARY OF THE INVENTION

The invention's solution is characterized by the features of the independent claim.

The metal fixing material bushing comprises a metal base plate, through which at least one metal pin is passed. If two metal pins are provided in a preferred embodiment, one of the two pins at least directly or indirectly via additional elements establishes the ground connection to the base plate. In the implementation with two metal pins these metal pins are preferably arranged parallel to one another. At least one of the metal pins is arranged in a opening in the base body and fixed across from said base body by means of fixing material, preferably in the form of a glass plug. As per the invention the base plate is formed by a sheet metal element, whereby in a first embodiment at least the opening is produced by means of a separation process, in particular punching. The base plate itself is preferably also punched out of a solid material, the final geometry of the base plate however is retained by means of a forming process for example deep drawing. In a preferred embodiment the final geometry describing the exterior contour and the base geometry describing the opening is produced at least by means of one separation process, in particular punching. Final geometry means that no more forming processes have to be performed on it. Base geometry means that it either represents the final geometry in the case of no further necessary changes or that changes can still be undertaken to said base geometry by means of further manufacturing methods, in particular forming methods, whereby the final geometry is not achieved until after these additional methods. Retention structures are provided between the front and the rear for avoiding a relative motion of fixing material in the direction of the rear toward the inner circumference of the. The structures are integrable components of the base plate or form together with the base plate a structural unit.

The production of the geometry by means of a separation process means that the final geometry on the outer circumference of the base plate is produced by means of blanking and the geometry of the opening is produced by means of punching. The structures for avoiding a relative motion of fixing material in the direction of the rear toward the inner circumference of the opening are provided for the purpose of getting control of the difficulties resulting from the sealing of the single metal pin in a opening and also for the purpose of security against a withdrawal of the unit fixing material and metal pin. Said retention structures act as a kind of barb and lead in the case of relative motion in the direction of the rear to a positive locking between fixing material plugs, in particular glass plug and base plate. These comprise for example at least one local contraction in the opening, whereby they can be provided in the entire region of the inner circumference, except for the front of the base plate.

The solution of the invention makes it possible to resort to a more cost-effective manufacturing method and starting materials, whereby the inventory is considerably minimized. Additionally, the entire base plate can be designed as an integral component, into which the metal pin is sealed by means of fixing material. Another significant advantage consists in the fact that even under increased loads on the single metal pin, for example a pressure load, a pressing out of the metal pin with the glass plug from the port opening is safely prevented. The overall design also builds smaller in width and is also applicable at a slighter size through the guarantee of the secure fixing of the metal pin in the base plate, even with higher loads.

Critical in the process is the fact that the local contraction of the cross section in the region of the rear or between the rear and front occur, whereby however the front is always characterized by a greater diameter.

In accordance with an especially advantageous design the second metal pin is grounded or fastened to ground as a ground pin on the rear of the base plate. As a result of this, additional measures for grounding a metal pin fixed in the base plate with fixing material or electrically coupling it to the base plate are no longer needed. Further, there is still only one pin to be fixed in a opening, whereby the possibilities for securely fixing the single pin completely in circumferential direction become more varied and the potential connecting surface for the ground pin can be enlarged.

For example a glass plug, a ceramic plug, a glass-ceramic plug or a high-performance polymer can be used as fixing material.

A number of possibilities exist for the concrete development of the resources for prevention of a relative motion between the fixing material and opening, in particular slipping out. These are characterized by measures on the base plate. In the simplest case measures on the base plate are resorted to, which can be implemented in production, particularly during the punching process. In the process the opening between the rear and the front is characterized by a change of the cross-sectional contour. In the simplest case at least two areas of variable inside dimensions are provided in the design as opening with circular cross section with variable diameter. In the process the cross-sectional change can take place in stages or continuously. In the latter case the opening between the front and rear is tapered in design, whereby said opening narrows to the rear. The measures on the base plate are as a rule further characterized by the provision of several recesses or projections. These form at least one undercut arranged between the rear and the front viewed on the inner circumference of the opening in the base plate, whereby the front is free of such undercuts. In the symmetrical construction of the opening this is characterized by three sub-areas—a first sub-area, which extends from the rear in the direction of the front, a second sub-area connected to the first one and a third sub-area, which extends from the front in the direction of the rear. The second sub-area is characterized by slighter or greater dimensions of the opening than the first and third sub-areas. Preferably the first and second sub-areas are then characterized by identical cross-sectional dimensions.

In implementations with more than two areas of variable dimensions, in particular with variable diameters methods are selected which result from machining both sides of the base plate. If in the previously described implementations an asymmetrical shape of the opening is intended, with these implementations with more than two areas preferably a development of the opening is selected which can be used in any way with regard to the mounting position. This is, relative to a theoretical center line which runs vertically to the pin axis of the pin in the base plate and which extends in the central area of the base plate, symmetrically designed. Therewith the front and the rear can, with regard to their function, also be exchanged. The undercuts formed by these counteract possible movements of the fixing material plug in both directions.

In accordance with a further design there can also be a multiple number of projections arranged in circumferential direction distanced to each other on a common length between the front and the rear. These are as a rule produced by stamping, i.e. Local forming under pressure in the area of the rear. The manufacturing process is thus especially cost-effective.

Another option for prevention of relative motions between fixing material plug and port consists in the forming of a positive connection between them. For example, normally the glass is placed in the opening together with the metal pin, the glass and metal ring are heated up, so that after the cooling the metal heat shrinks onto the glass plug. In general the opening exhibits in essence the final diameter after the punching of the opening. Naturally the punched opening can itself be machined, for example polished without the final diameter changing significantly. The opening can have a circular cross section. Other possibilities are conceivable, for example an oval cross section.

In accordance with an advantageous further development for additional prevention of relative motions under load between metal pin and fixing material measures on the metal pin are provided. In this process this can be a matter of projections or recesses extending over the entire outer circumference of the metal pin or with random or fixed predefined projections arranged next to each other in circumferential direction.

The method for manufacturing a base plate of a metal bushing is characterized by the fact that the end contour describing the outer geometry is gained by means of a separation process free of machining from a sheet metal part of predefined thickness. The achievement of the base geometry describing the form of the opening for formation of the opening also occurs for at least one metal pin by means of punching out of the sheet metal part. In the process both operations can be in cost-saving fashion in a single tool and one processing step. The undercuts in the openings are developed by means of deformation of the openings, for example by means of stamping. The single stamping operation can be undertaken before or after the punching operation. Preferably the stamping and punching operation take place on the same side of the base plate, to avoid unnecessary workpiece position changes and perhaps have these processes run one immediately after the other.

Corresponding to the desired geometries to be attained the stamping operations occur either on one side or both sides, whereby in the latter case preferably identical stamping parameters are set, in order to ensure a symmetrical implementation of the opening.

According to the invention a metal-sealing material-feedthrough is described in a special design as a glass-to-metal-feedthrough, including one metallic base body through which at least one metal pin is inserted. If two metal pins are provided in a preferred design form then at least one of the two provides the ground connection to the base body at least indirectly, in other words, directly or indirectly through additional elements. In a design having two metal pins said metal pins are located parallel to each other. At least one of the metal pins is located in a feedthrough opening in the base body and is sealed relative to it through sealing material, such as in form of a glass slug. The base body is formed from a sheet metal element wherein in a first design form at least the feedthrough opening is created by a separation process, especially by punching. The base body itself is punched from a solid material. The final geometry of the base body however is achieved through a forming process, for example through deep-drawing. In a preferred design form the final geometry describing the outer contour and the basic geometry describing the feedthrough opening is produced at least by a separation process, especially punching. Final geometry means that no further forming processes will be conducted on this form. Basic geometry means that this either represents the final geometry if no further changes are required or that changes through ways of additional manufacturing processes, especially forming processes may be made, wherein the final geometry is achieved only following these additional processes. Ways are provided between the front and the back side in order to avoid a relative movement of sealing material in the direction toward the back relative to the inside circumference of the feedthrough opening, especially during ignition. The ways are an integral component of the base body or embody a structural unit with same. The manufacture of the base body by way of punching provides the advantage of short manufacturing periods and permits free forming, especially of the feedthrough opening The inventive metal-sealing material-feedthrough includes at least one metal pin which is placed in a feedthrough opening in the base body in a sealing material, wherein the base body has a front and a back side. Ways are provided between the front and the back side in order to avoid a relative movement of sealing material in the direction toward the back relative to the inside circumference of the feedthrough opening.

Metal-sealing material-feedthrough openings can generally be characterized by the so-called ejection force and by the extraction force. The ejection force is that force which must be applied in order to eject the sealing material which is placed in the feedthrough opening of the metal-sealing material-feedthrough from said feedthrough. The level of the ejection force may be determined either hydrostatically or mechanically.

If the ejection force is determined mechanically then the surface of the sealing material is treated with a die wherein the die surface which presses upon the sealing material is smaller than the surface of the sealing material. Alternatively, the ejection force may be measured hydrostatically. In this instance the sealing material is treated with a hydrostatic pressure, for example with water pressure and is then measured; wherein the sealing material is expelled from the feedthrough opening by said hydrostatic pressure.

The extraction force is that force which is required in order to pull the metal pin of the metal-sealing material-feedthrough out of the sealing material. At least the feedthrough opening on the base body is produced by punching. In a further developed design form of the invention the entire base body, in other words the outside circumference of the base body, as well as the feedthrough opening may also be produced by punching. The entire base body is then constructed as a punched component.

The base body is configured so that the ratio between the thickness of the base body and the maximum dimension of the feedthrough opening vertical to the axis direction of the feedthrough opening is in the range of between and including 0.5 to 2.5. When considering the ratio of thickness D of the base body to the maximum dimension of the feedthrough opening after punching of the feedthrough opening, however before grinding of the feedthrough opening, then this ratio is preferably in the range of 0.6 to 2.5. When considering the ratio of thickness D of the base body to the maximum dimension of the feedthrough opening after a grinding process of the feedthrough opening, then this ratio is preferably in the range of 0.5 to 2.

In accordance with an embodiment, the ratio between the thickness D of the base body and the maximum dimension of the feedthrough opening vertical to the axis direction of the feedthrough opening after grinding is in the range of between and including 0.8 to 1.6, preferably 0.8 to 1.4, especially preferably 0.9 to 1.3, more especially preferably 1.0 to 1.2.

Thickness refers to the extent or dimension in height direction or direction of the extension of the feedthrough opening. The geometric axis of the feedthrough opening is determined depending on the construction of said feedthrough opening. In a symmetric design it corresponds to a symmetrical axis, otherwise to a theoretical center axis.

For applications in ignition devices for airbags base bodies having a thickness of between 1 mm and 5 mm, preferably 1.5 mm and 3.5 mm, especially preferably 1.8 mm to 3.0 mm, more especially preferably 2.0 mm to 2.6 mm are used. Even with consistently sized metal pins this represents a considerable saving in materials due to the smaller dimensions compared to the pivoted component which has thicknesses for example, of 3.2 mm to 5 mm, as well as providing an energy saving manufacturing process. In addition, the reduction in the support surface for the sealing material slug which is inherent with the reduction in the thickness can be compensated for with regard to its function, by simple measures which require almost no additional expenditure.

There are no limitations with regard to the cross sectional geometry of the feedthrough opening. However, a circular or oval cross section can be selected in order to achieve a uniform distribution of tension in the connection between the sealing material and the feedthrough opening. In a circular or oval cross section the diameter of the feedthrough opening is then in the range of 1.4 mm to 4 mm, preferably 1.4 mm to 3.5 mm, especially preferably 1.6 mm to 3.4 mm. The diameter of the metal pin is for example 0.8 to 1.2 mm.

The metal-sealing material-feedthrough includes a metallic base body through which at least one metal pin is inserted. If two metal pins are provided, then at least one of the two provides the ground-connection to the base body at least indirectly, in other words, directly or indirectly through additional elements. In a design having two metal pins said metal pins can be located parallel to each other.

At least one of the metal pins is located in a feedthrough opening in the base body and is sealed relative to it through sealing material, such as in form of a glass slug. In order to account for the problem arising from fusing of the individual metal pin into a feedthrough opening and also for safeguarding against expulsion of the sealing material and metal pin entity, ways are provided to avoid a relative movement of sealing material in the direction toward the back side relative to the inside circumference of the feedthrough opening. These act as barbs and during relative movement in the direction toward the backside lead to a positive fit between the sealing material slug, especially a glass slug and the base body. They include for example at least one local narrowing of the feedthrough opening wherein this can be provided in the entire area of the inside circumference, with the exception of the front side of the base body.

The current invention provides for cost effective manufacturing processes and starting materials wherein the material usage is considerably reduced. The entire base body may also be constructed as an integral component into which the metal pin is fused by way of the sealing material, in other words for example by way of the glass slugs. An additional substantial advantage is that even under an increased load upon the glass slug—for example a pressure load—pushing the glass blob with the metal pin out of the feedthrough opening can probably be avoided. The entire embodiment when compared with a pivoted component is lower in height and assures a secure bonding of the glass slug in the base body, even during high ejection force.

It is however critical that the local narrowing of the cross section occurs in the area of the backside or between the back side and the front side, wherein however the front side is always characterized by a larger diameter. The cited ratio details always refer to the largest cross section or the largest dimension of the feedthrough opening. The dimensional reduction—resulting from the undercut—of the area adjacent to this vertical to the direction of axis of the feedthrough opening originating from the axis, or the difference between the dimensions of the largest and the smallest cross section is always in the range of between 0.05 mm to 1 mm, preferably 0.08 mm to 0.9 mm, preferably between 0.1 mm to 0.3 mm. Accordingly this dimension provides an enlargement of the surface at the inside circumference of the feedthrough opening which is sufficient to maintain the ratio between thickness and dimension of the feedthrough opening relative to a very small thickness and at the same time to increase the ejection force accordingly. If the feedthrough opening is circular for example, the largest dimension of a cross section is characterized by the diameter of the feedthrough opening. In the instance of an elliptical shape the largest dimension is the dimension of the large axis of the ellipse.

In accordance with another embodiment the second metal pin is placed or secured as a grounding pin to ground at the back side of the base body. This eliminates additional measures of having to ground a metal pin that is sealed into the base body with sealing material, or having to connect it electrically with the base body. In addition, only one pin then needs to be sealed into one feedthrough opening, providing a plurality of possibilities to securely seal the single pin completely in circumferential direction; and the possible connection area for the ground pin can be enlarged.

A glass slug, a ceramics slug, a glass-ceramic slug, a synthetic material, a high performance polymer or a glass/polymer mixture can be used as sealing material. A plurality of possibilities exists for the specific development of the way for the prevention of a relative movement between sealing material and feedthrough opening, especially prevention of sliding out. These are characterized by measures on the base body and/or the metal pin. In the simplest form one would revert to measures on the base body which can be realized during manufacturing, especially during the punching process. In this context the feedthrough opening distinguishes itself by a change of the cross sectional progression between the back side and the front side. In the simplest form at least two areas of different inside dimensions are provided in an embodiment of a feedthrough opening that has a circular cross section with different diameters. The cross section change may occur in stages or progressively. In the latter scenario the feedthrough opening is conical between the front and the back, wherein it narrows toward the back side.

The ejection force can be significantly increased through the described measures that can be taken in the area of the feedthrough opening. In the examples according to the current invention including undercut, the hydrostatic pressure which must be applied in order to eject the glass slug is 1500 bar to 2500 bar, preferably 2000 bar to 2500 bar. Or, in other words, the force which must be applied mechanically upon the glass slug in order to eject the glass slug is 1750 N to 3000 N, preferably 2000 N to 3000 N.

The measures which are applied to the base body are normally further characterized by the provision of several recesses or protrusions. These form at least one undercut—originating from the backside—on the inside circumference of the feedthrough opening in the base body between backside and front side wherein the front side has no such undercuts. In a symmetrical embodiment of the feedthrough opening said feedthrough opening is characterized by three partial segments—a first partial segment which extends from the backside in the direction of the front side, a second partial segment adjacent to this and a third partial segment which extends from the front side in the direction of the back side. The second partial segment is characterized by smaller dimensions of the feedthrough opening than the first and the third partial segment. The first and the third partial segments are then characterized by identical cross sectional dimensions.

In embodiments having more than two segments of different dimensions, especially different diameters, methods are selected which are created by two-sided treatment of the base body. If the previously described designs are geared toward an asymmetrical arrangement of the feedthrough opening then a feedthrough opening design is selected in these arrangements having more than two segments which can be used as desired with regard to the installation position. This is shaped symmetrical, relative to a theoretic center axis which progresses vertical to the pin axis of the pin which is located in the base body and which extends in the center area of the base body. This means that the front and backside are interchangeable regarding their function. The thereby formed undercuts counteract possible movements of the sealing material slug in both directions.

An additional possibility to avoid relative movements between the sealing material slug and the feedthrough opening consists in the provision of a frictional connection between these. Normally, for example, the glass is inserted into the opening together with the metal pin. The glass and metal pin are heated, so that after cooling the metal shrinks onto the glass slug. The feedthrough opening generally represents essentially its final diameter after being punched. Naturally, the punched feedthrough opening may be further processed, for example ground without substantially altering the final diameter. The feedthrough opening may have a circular cross section. Other possibilities are feasible, for example an oval cross section.

In accordance with an advantageous further development measures are provided on the metal pin, in order to further prevent relative movement occurring under load between the metal pin and the sealing material. This may be at least one protrusion which extends in circumferential direction around the entire outside circumference of the metal pin. Alternatively, being optional or strictly pre-defined, this may respectively be protrusions or recesses extending over the entire outside circumference of the metal pin, such as firmly positioned protrusions located adjacent to each other and in circumferential direction. Due to measures taken on the metal pin the extraction force of the metal pin is in the range of 160 N to 380 N, preferably 300 N to 380 N.

The method for the fabrication of a base body of a metal-feedthrough is characterized in that in order to obtain the base geometry which describes the fundamental shape of the feedthrough opening for at least one metal pin it is punched from a sheet metal component. The end contour describing the outer geometry may be obtained by a separation process without tension-causing processing of a sheet metal component of pre-defined thickness. Both processes may be combined in a cost saving effort to one machine tool and one operating cycle. The undercut in the feedthrough openings are formed by change in shape of the feedthrough opening, for example through stamping. The individual stamping process may occur before or after the punching process. The stamping and punching process respectively could occur on the same side of the base body in order to avoid unnecessary position changes of the work piece and to possibly conduct these processes immediately following each other. According to the desired geometry that is to be obtained, the stamping processes occur on one or on both sides, wherein in the latter scenario identical stamping parameters can be set in order to assure a symmetrical appearance of the feedthrough opening.

Materials for the base body can be metals, especially standard steel such as St 35, St 37, St 38 or special steel or stainless steel types. Stainless steel according to DIN EN 10020 is a designation for alloyed and unalloyed steels whose sulfur and phosphor content (so-called companion elements to iron) does not exceed 0.035%. Additional heat treatments (for example tempering) are often provided subsequently. Special steels include for example high purity steels wherein components such as aluminum and silicon are eliminated from the molten mass in a special manufacturing process. They also include high alloy tool steels which are intended for later heat treatment. The following are examples of what may be utilized: X12CrMoS17, X5CrNi1810, XCrNiS189, X2CrNi1911, X12CrNi177, X5CrNiMo17-12-2, X6CrNiMoTi17-12-2, X6CrNiTi1810 and X15CrNiSi25-20, X10CrNi1808, X2CrNiMo17-12-2, X6CrNiMoTi17-12-2. The advantage of the aforementioned materials, especially the cited tool steels, is that when using these materials a high corrosion resistance, a high mechanical rigidity as well as excellent weldability is assured, especially where the base body is in the embodiment of a punched component with a welded edge.

The inventive metal-sealing material-feedthrough, especially glass-metal feedthrough, may be utilized in ignition devices of any desired design. It may for example be provided in an ignition device for a pyrotechnic protective device, especially an airbag or belt tensioning device, including a cap which is connected with the metal-sealing material-feedthrough, especially with the base body, wherein a propellant is enclosed between the metal-boding material-feedthrough and the cap and wherein the base body has a welded edge that is thinner than the interior part or section, wherein the cap is welded to the welded edge with a continuous weld seam.

There are no limitations with regard to the geometry of the outer contour of the base body. However, if said base body is in the form of a punched component it can be in circular form. The location of the feedthrough may be co-axial or eccentric to the opening center axis, or in a symmetrical embodiment of the outside contour of the base body it may be co-axial or eccentric to the axis of symmetry.

The ignition devices with the inventively constructed metal-sealing material-feedthrough can be utilized in gas generators, for example hot gas generators, cold gas generators, hybrid generators. Additional areas of application are ignition devices for pyrotechnical protective systems, for example airbags and belt tensioning devices.

Furthermore, such ignition devices can be used for escape slides in air crafts, roll-over-bars in cars, commercial mining and blasting as well as for pyrotechnic for devices which lift an engine hood in case as car collides with a pedestrian.

The invention further provides for a method for manufacturing a metal fixing material bushing, especially a metal-sealing material feedthrough preferably for igniters of airbags or beet tension pulleys, in which from one part, in particular a sheet metal part, of predefined thickness the final contour describing the outer geometry is gained by means of a separation process and in which to form the slot for at least one metal pin the base geometry describing the starting form of the slot is gained by means of punching out of the part, in particular of the sheet metal part. Preferably the thickness of the sheet metal part is between 1 mm and 5 mm, preferably between 1.5 mm and 3.5 mm, especially preferable between 1.8 and 3.0 mm, most preferable between 2.0 to 2.6 mm.

In even a further embodiment the method is characterized by the fact that the final contour describing the outer geometry gained by the separation process and the base geometry describing the starting form of the slot are produced in one processing step in the form of punching out with a tool. Tools for punching out the slot for at least one metal pin or the final contour are known by a person skilled in the art. Punching is a metal fabricating process that removes a scrap slug from the metal workpiece each time a punch enters the punching die. This process leaves a hole in the metal workpiece.

Characteristics of the punching process include:

Its ability to produce economical holes in both strip and sheet metal during medium or high production processes.

The ability to produce holes of varying shapes quickly.

The punching process forces a steel punch, made of hardened steel, into and through a workpiece. The punch diameter determines the size of the hole created in the workpiece.

Normally the workpiece remains and the punched part falls out as scrap as the punch enters the die. The scrap drops through the die and is normally collected for recycling.

In a further embodiment the undercuts in the slots are formed by deformation of the slot.

In an embodiment the method is characterized by the fact that the deformation is achieved by means of at least one stamping operation.

According to an embodiment the method is characterized by the fact that the stamping and punching operations are performed from the same side on the base plate.

In an alternative embodiment the method is characterized by the fact that the stamping and punching operations are performed from different sides on the base plate.

In even a further embodiment the method is characterized by the fact that the stamping and punching operations are performed on both sides on the base plate.

For stamping and punching tools with the same parameters could be used.

In order to make the punching process more easy prior to the punching out of the slot in the area of the slot to be produced on the sheet metal part a stamping operation can be performed.

After the punching step the socket of the base plate can be obtained by means of deep drawing.

The undercuts in the slots can be formed by deformation of the slot in a further embodiment.

BRIEF DESCRIPTION OF THE DRAWINGS

The invention's solution is explained in detail in the following using figures. The figures show the following:

FIG. 1*a* illustrates a first embodiment of a metal fixing material bushing designed as per the invention;

FIGS. 1*b* through 1*f* illustrate in greatly simplified diagrammatic view the basic principle of a method as per the invention for manufacturing a base plate in accordance with the invention;

FIG. 13 provides Table 1;

FIG. 14 provides Table 2:

DETAILED DESCRIPTION

Figure 2A:
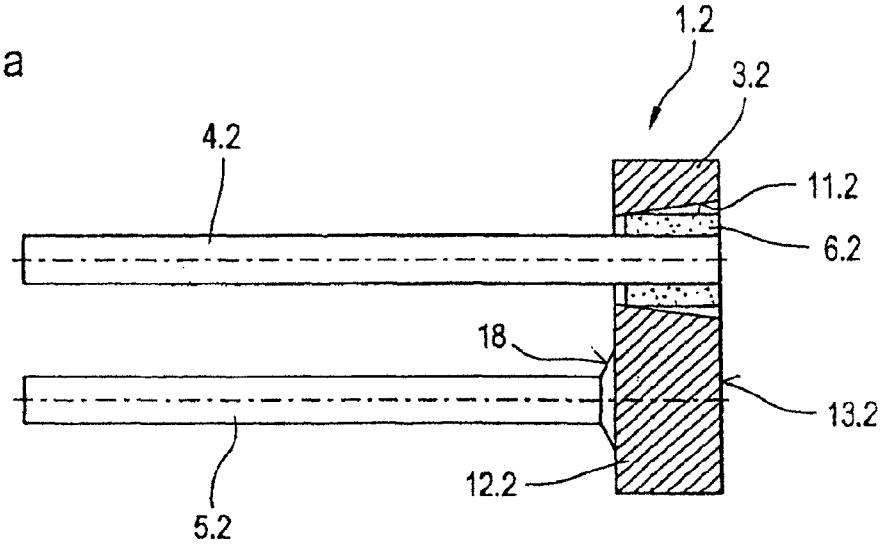
FIG. 2*a* illustrates a second embodiment of a metal fixing material bushing designed as per the invention with tapered design of the opening.

FIG. 1*a* illustrates a first implementation of a metal fixing material bushing 1 designed as per the invention using an axial section, for example for use as an igniter of an airbag. This comprises a base plate 3 forming a metal collar, with which two parallel metal pins 4 and 5 are electrically coupled. The two metal pins 4 and 5 are arranged parallel to one another. In the process one acts as a conductor, while the second pin is grounded. In the represented case the first metal pin 4 acts as a conductor and metal pin 5 acts as the ground pin. At least one of the metal pins, in particular the metal pin 4 acting as the conductor is guided through the base plate 3. In the represented case the ground pin 5 is directly attached to the rear 12 of the base plate 3. The metal pin 4 is for this purpose sealed on a part $l_1$ of its length l in fixing material such as a glass plug 6 cooled from molten glass. The metal pin 4 protrudes at least on one side over the face 7 of the glass plug 6 and in the represented embodiment seals flush with the second face 8 of the glass plug 6. Other variants are also conceivable. Preferably not only the opening, but also the base plate 3 is designed as a punched element. This means that the geometry describing the outer contour, in particular the outer circumference 10 is produced by means of blanking, preferably punching. The punch part can either continue to be used in the geometry as it is present after the punching operation or can be deformed in a further operation, for example it can be deep drawn. The opening 11 provided receiving and fixing of the metal pin 4 by means of the glass plug 6 is produced in a preferred embodiment by means of a punching operation in the form of slotting. Subsequently the metal pin 4 is inserted at the rear 12 of the metal fixing material bushing 1 together with the glass plug into the opening 11 and the metal plate containing the glass plug and the metal pin is heated, so that after a cooling operation the metal heat shrinks and in this way a non-positive connection between glass plug 6 with metal pin 4 and base plate 3 is formed. It is also conceivable to insert the fixing material in molten or fluid state, in particular the molten glass from the front side 13 into the opening 11. During the cooling a positive and material connection incorporated into the material comes into being both between the outer circumference 14 of the metal pin 4 as well as between the inner circumference 15 of the opening 11. To prevent a loosening of the metal pin 4 with the glass plug 6 from the base plate 3 in the case of stress of the entire metal fixing material bushing 1 during ignition, retention structures can be provided for prevention of a relative motion between fixing material 6 and inner circumference 15 of the opening in the direction of the rear side 12. These act sort of as a barb and bring about a positive locking between base plate 3 and glass plug 6 under tensile force influence and/or pressure on the glass plug 6 and/or the metal pin 4 and prevent therewith a slipping out at the rear 12. For this purpose as per a first embodiment the opening 11 is designed in such a way that it has an undercut 36, which is formed by a projection 37. This projection is arranged in the region of the rear 12 and in the represented case closes flush with it. The opening 11, which in the represented case is preferably designed with a circular cross section, is characterized through this projection 37 by means of two different diameters $d_1$ and $d_2$. Diameter $d_1$ is greater than diameter $d_2$. Diameter $d_2$ is the diameter of the opening 11 at the rear 12. Diameter $d_1$ is the diameter of the opening 11 at the front 13. Thereby the opening 11 is executed over a significant part of its extent $l_{d1}$ with the same diameter $d_1$. $L_{d2}$ stands for the design of opening 11 with diameter $d_2$. That is, the opening has two sub-areas, a first sub-area 16 and a second sub-area 17, whereby the first sub-area 16 is characterized by diameter $d_1$ and the second sub-area 17 is characterized by diameter $d_2$. These diameters are produced thereby by means of a single-sided stamping operation in the form of slotting of the sides of the front 13 or rear 12 with subsequent deformation operation under the influence of pressure, particularly stamping, as represented in FIGS. 1*b* through 1*c* on base plate 3. Preferably the punching and deformation operation each occur from the same side, in the represented case from the front 13. The blanking of base plate 3 can also take place within the framework of a punching operation or a preceding cutting operation, for example water-jet cutting or laser-beam cutting. Preferably this takes place however by means of punching. The tool for this is designed in such a way that the entire base plate 3 with a opening 11 is punched out in one processing step out of sheet metal 38 of a specified sheet thickness b, which corresponds to a thickness D of base plate 3.

FIGS. 1*b* through 1*e* illustrates in diagrammatically simplified representation the basic principle of the invention's method for manufacturing of a base plate 3 with the required geometry. FIG. 1*b* illustrates in diagrammatically simplified representation the design of the punching tool out of two sub-tools, one bottom part in the form of a die 40 and one upper part in the form of a punch 41. In the process the punch 41 moves toward the sheet metal 38 lying on a matrix. The feed direction is designated by an arrow. The base plate 3' resulting from this with regard to its outer final geometry and the geometry of the opening 11' after the punching is reproduced in FIG. 1*c*. The base plate 3' can in this state and this position undergo a further stamping operation, in order to achieve the geometry of the opening 11' shown in FIG. 1*a*, I particular the undercut 36 formed by the projection 37. The stamping tool 42 is allocated to the front 23 of the base plate 3' and is active on the opening 11', as present after the punching, from the side of the front 12 in the direction of the rear 12. The active depth $t_1$, which in the final state of the base plate 3 characterizes the distance of the undercut 36 from the front 13 is guaranteed in the process by means of the form of the stamping tool 42 and the stamp depth conditioned by it or else only through the stamp depth. FIG. 1*e* illustrates the position of the stamping tool 42 toward the base plate 3' in the final state, and FIG. 1*f* illustrates the stamping operation being performed from the opposite side. After successful stamping, whereby in this state the base plate 3' corresponds to the base plate 3. The finishing metals characterize the state of the element to be machined during production. In order to achieve an optimum stamping result, metallic materials with good flowability in the selected pressure impact are used as sheet metals 38 or thin elements. Preferably CuNi alloys or Al alloys or Ni or Fe alloys are used as metals. The use of steels, for example stainless steel, CRS 1010, constructional steels or Cr—Ni steel is particularly preferable.

In the implementation shown in FIGS. 1*a* through 1*e* the opening 11 has a circular cross section. However, other forms are also conceivable, whereby in this case an undercut is formed by means of changing the inner dimensions of the opening. Further the displayed geometries are reproduced idealized. For example, in practice, as a rule surface areas that are not completely at right angles to each other will develop. It is crucial that a base contour of the opening be created, which for one does justice to the reception of a sealed metal pin and further the prevention of an outward movement of the totality of metal pin and fixing material, in particular the glass plug, i.e. Also the surface areas forming the undercut and the adjacent surface areas can be arranged at an angle to each other.

FIG. 2*a* illustrates a further design of the base plate 3.2 using an axial cut through a metal fixing material bushing 1.2. The base structure of the metal fixing material bushing 1.2 corresponds to the one described in FIG. 1, for which reasons the same reference symbols are used for the same elements but with a suffix corresponding to the figure number. In the implementation as per FIG. 2*a* the opening 11.2 is however has a tapered design. In the process the diameter proceeding from the front 13.2 to the rear 12.3 decreases steadily. This steady decrease in diameter by means of the formation of a cone embodies the resource for the prevention of a relative motion between the fixing material and the inner circumference of the opening.

Figure 2B:
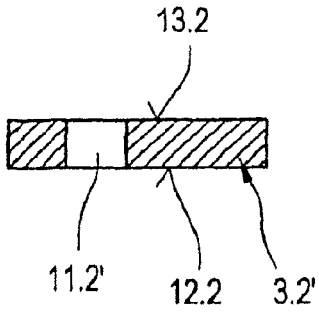
FIGS. 2*b* through 2*c* illustrate a further embodiment of the method as per the invention for manufacturing a base plate in accordance with FIG. 2*a* after a punching operation.
Figure 2C:
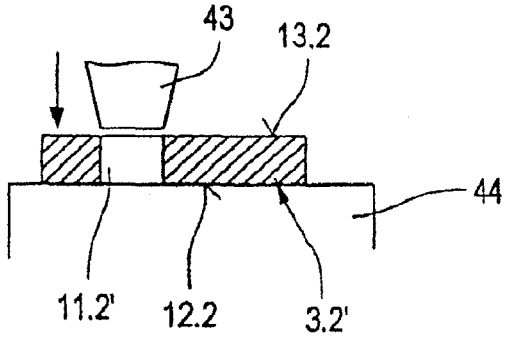

FIG. 2*b* illustrates the base plate 3.2' resulting after the punching operation after stamping. An opening 11.2' can be seen with equal dimensions throughout. FIG. 2*c* illustrates the stamping tool 43, which has a tapered design and acts on the base plate 3.2' as per FIG. 2*b* from the front 13.2 against a die 44. In contrast to this, FIG. 3 discloses a combination of the implementation according to FIGS. 1 and 2, in which only a part of the opening 11.3 has a tapered design. In this implementation the opening 11.3 of the metal fixing material bushing 1.3, particularly in base plate 3.3 is also divided into two sections, a first sub-area 16.3 and a second sub-area 17.3. The second sub-area 17.3 is characterized by a constant diameter $d_{2.3}$ over its length $l_{d2.3}$. The second sub-area 17.3 extends from the rear 12.3 toward the front 13.3. The first sub-area 16.3 is characterized by a constant cross section reduction of the opening 11.3. The reduction takes place from a diameter d1.3 up to a diameter d2.3. The low diameters at the rears 12.2, 12.3 as per the implementations of FIGS. 2 and 3 offers the advantage of a greater connecting surface 18 for metal pin 5.2 or 5.3, in particular for the ground pin. The undercut 36.3 results on the basis of the diameter change viewed from the second to the first sub-area 16.3.

Figure 3:
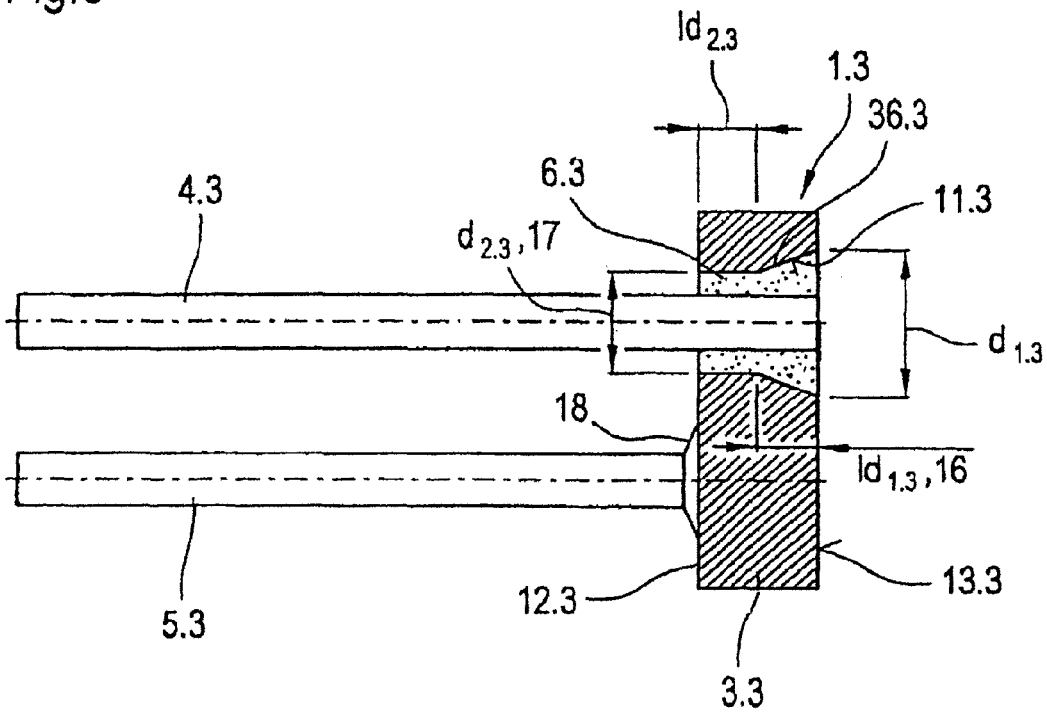
FIG. 3 illustrates a third embodiment of a metal fixing material bushing designed as per the invention with partially tapered design of the opening.

In all of the embodiments shown in FIGS. 1 through 3 the asymmetrical geometry of the opening 11, when considered from the front 13 to the rear 12, offers the advantage of prevention of a slipping or pulling out of the glass plug 6 at the rear 12 or in the direction of the rear. Additionally, during the assembly as a result of the asymmetrical geometry there can be an easier orientation for the mounting position of the individual elements, in particular the metal pins 4 and 5. On the basis of the undercut a loosening of the constructional unit from metal pin 4 and the glass plug 6 from the base plate during ignition can be avoided. The additional material at the rear 12 offers the advantage of a greater connecting surface for the metal pin 5.3 to be grounded. Further this increases the strength of the glass seal of the metal pin in case of pressure impact on the front.

Figure 4:
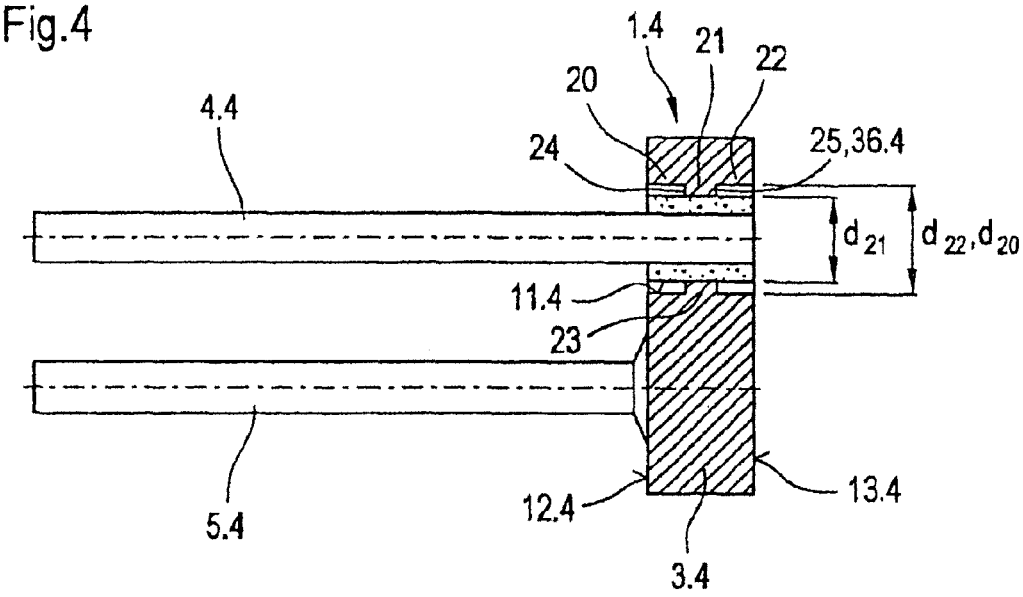
FIG. 4 illustrates an embodiment of the metal fixing material bushing designed as per the invention with a projection between the front and rear in the contour describing the opening.
Figure 5:
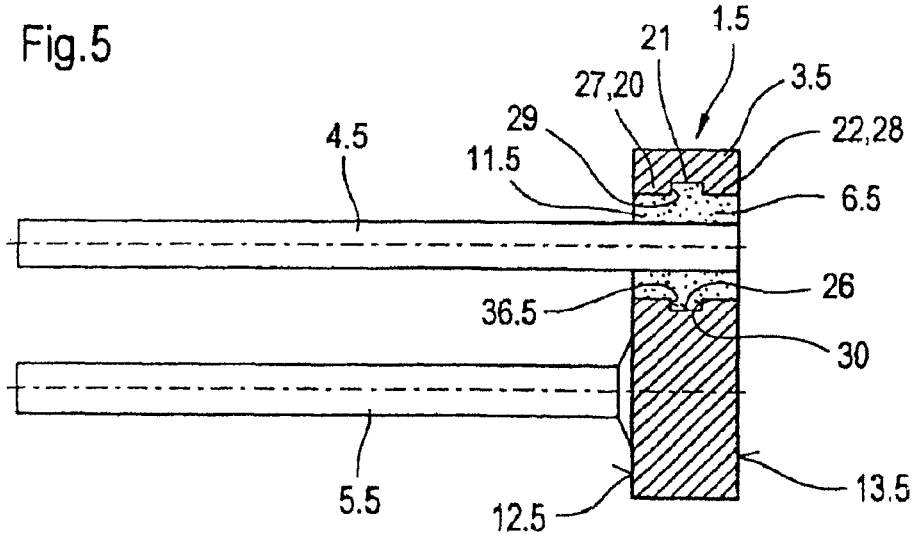
FIG. 5 illustrates an embodiment of the metal fixing material bushing designed as per the invention with a recess between the front and rear in the contour describing the opening.

FIGS. 4 and 5 illustrate two further implementations of a metal fixing material bushing 1.4 and 1.5 as per the invention with opening 11.4 and 11.5. With these implementations the opening 11 can be subdivided into three sub-areas. In the case of the implementation as per FIG. 4 in the sub-areas 20, 21, 22, whereby the first and third sub-areas 20 and 22 are preferably characterized by the same diameter $d_{20}$ and $d_{22}$. The second sub-area 21 is characterized by a lesser diameter $d_{21}$ than diameters $d_{20}$ and $d_{22}$ and forms therewith a projection 23. Said projection forms the undercut 36.4 arranged between the front and rear for prevention of relative motion of the glass plug 6.4 in the direction of the rear 12.4 towards the inner circumference 15.4 of the opening 11.4. In particular the surfaces 24 and 25 directed toward the front 13.4 and rear 12.4 from the stop faces for the glass plug 6.4 in axial direction. This implementation is characterized by a fixing of the glass plug 6.4 in both directions, so that this development is suitable in particularly advantageous fashion for being randomly incorporable and positionable, particularly with regard to the connection of the metal pins 4.4. This also holds true in analogy for the development of the metal fixing material bushing 1.5 presented in FIG. 5, in particular of the base plate 3.5. This development can also be subdivided into at least three sub-areas, whereby these individual sub-areas, which are marked here as 20.5, 21.5 and 22.5, form an undercut in the form of a recess 26, which is arranged between the rear and front 12.5 and 13.5 respectively. The two outer sub-areas—first sub-area 20.5 and third sub-area 22.5—form in the process projections 27 and 28. The surfaces 29 and 30 of the individual projections 27 and 28 pointing at each other in the process form a stop for the cooled glass plug 6.5 in shifting between rear 12.5 and front 13.5. Both implementations cause an increase of the required hydrostatic forces in order to set the glass plug 6 in motion under shearing of parts of them in the case of pressure load.

With all of the solutions described up to now it is possible to use a narrower base plate 3 in comparison to the known solutions from the state of the art with equal or increased strength of the seal caused by the glass plug 6.

The production of the base plate 3.4 as per FIG. 4 occurs by means of punching of the base plate 3.4 with a opening 11.4 with constant diameter. The projection is achieved by means of two-sided stamping with a predefined stamp depth and a stamping tool with a greater diameter than the existing diameter of the opening after the punching. On the basis of the increase of the surface tension of the material on the base plate under the influence of the stamping tool in the case of the exceeding of the flow limit a flow of the material occurs, which then forms the projection 23. In the process it is irrelevant whether the stamping operation takes place first from the front or rear of the base plate.

In case a symmetrical design is desired, the stamping forces and the stamp depth should however be selected equally for both sides. The effected implementations apply in analogy also for the formation of the base plate as per FIG. 5. Here, too in the first processing step a punching out of the outer geometry of the base plate 3.5 with opening 11.5 occurs. The two projections 27 and 28 in the area of the front and rear 12 and 13 are then formed by means of the pressure forces becoming active on the front and rears 12.5, 13.5 on the base plate 3.5. In the process the represented form of the recess is idealized.

Figure 6:
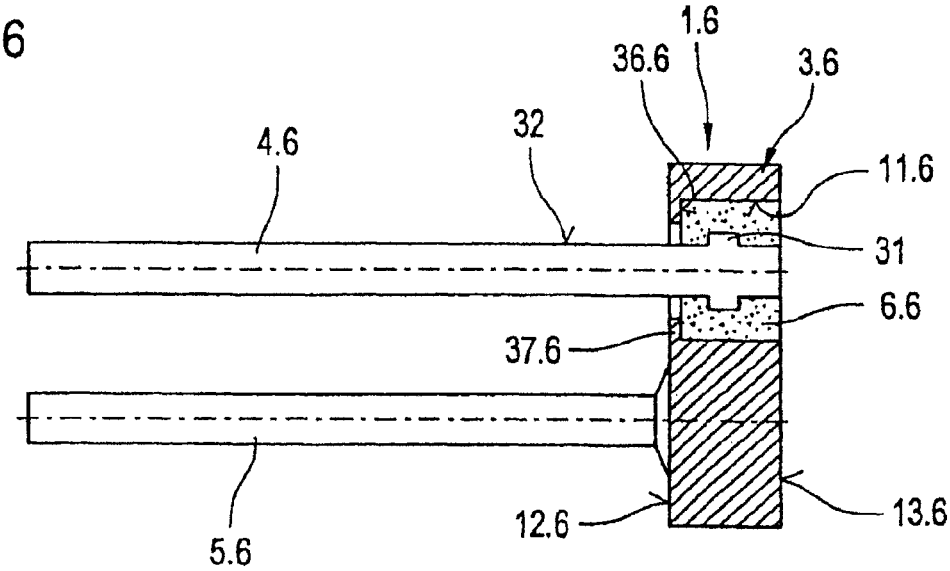
FIG. 6 illustrates an implementation as per FIG. 1*a* with additional projections on the metal pin.
Figure 7:
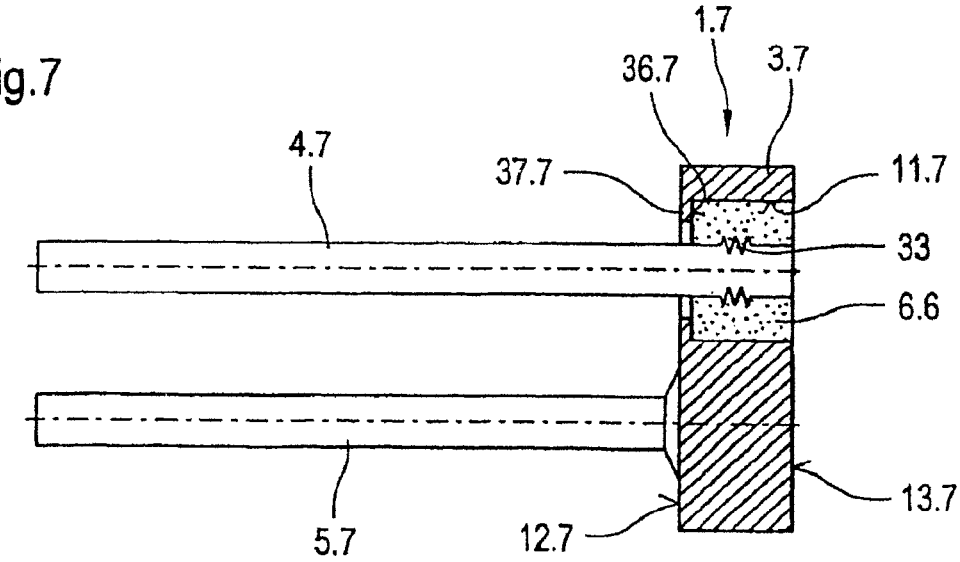
FIG. 7 illustrates a further development as per FIG. 6.

If FIGS. 4 and 5 illustrate measures on the base plate 3.4 or 3.5, in particular the openings 11.4 and 11.5 for prevention of a relative motion of the glass plug 6 toward them, FIGS. 6 and 7 show measures on the metal pin 4.6 or 4.7 which serve to prevent movement of the of the metal pin 4.6 or 4.7 out of the glass plug 6.6 or 6.7 during the test and further during the ignition operation. FIG. 6 represents a combination of the implementation presented in FIG. 1 with additional modification of the metal pin 4.6. The pin 4.6 has at least one projection in the coupling area with base plate 3.6, said projection is marked 31 and extends in circumferential direction around the outer circumference 32 of the pin 4.6. In the presented implementation it is a matter of a projection 31, which extends around the entire outer circumference 32 of the metal pin 4.6. This projection can be formed by means of compressing or squeezing of the metal pin 4.6. Another possibility not shown here contains the arrangement of several projections adjacent to each other in circumferential direction, preferably arranged adjacent to each other at an equal distance on the metal pin 4.6 in the area of the coupling n the base plate 3.6. The feature of projections on the metal pin 4.6 contributes considerably to the improvement of the strength of the connection. This feature prevents the removal of the metal pin 4.6 during a corresponding test, in which normally the metal pin fails with tensile stress and removal of the glass plug. This holds true in analogy for the development as per FIG. 7. With this development, the metal pin 4.7 has in the contact area with the molten glass a number of projections arranged from above the axial extent of the opening, which are connected in series. In the simplest case a fluting 33 is used. With this fluting the same effect can be achieved as described in FIG. 6. The remaining structure matches that described in FIG. 6, which is why the same reference symbols are used for the same elements.

The implementations described in FIGS. 6 and 7 can additionally also be combined with the measures presented in FIGS. 2 through 5 on the base plate, in particular the openings.

Figure 8:
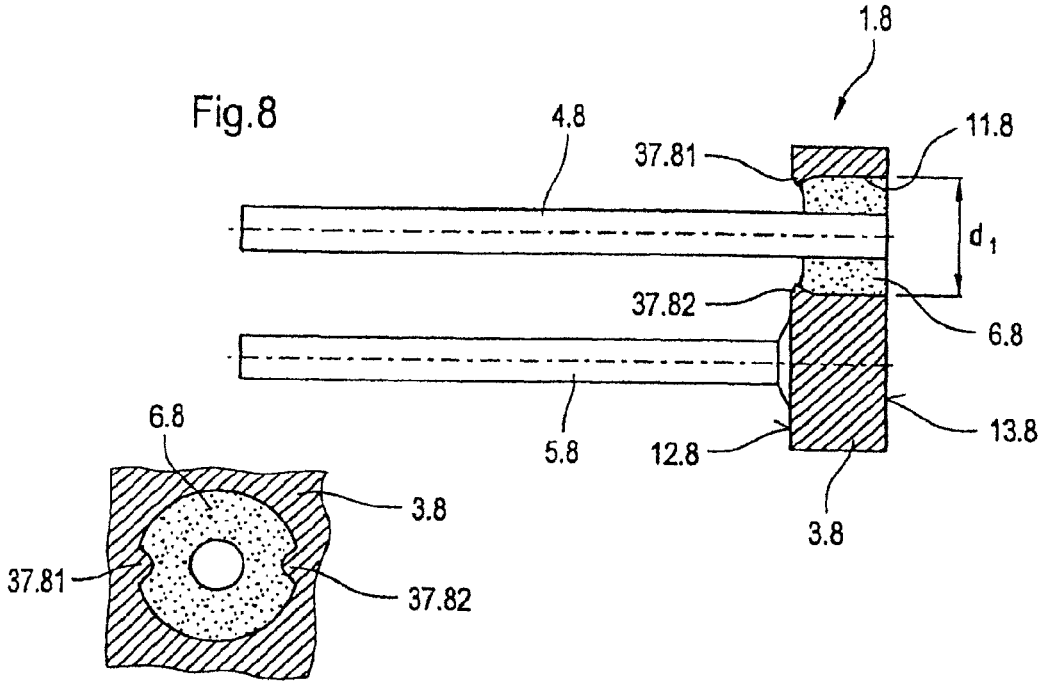
FIG. 8 illustrates a further embodiment of the metal fixing material bushing designed as per the invention with punctual contraction of the cross section in the region of the rear.

FIG. 8 shows a development in which the opening 11.8 is with the same diameter over the entire extent between rear 12 and front 13, whereby in the area of the rear 12.8 the base plate 3.8 is exposed to a stamping process. This takes place by means of pressurization on the rear 12.8, whereby this pressurization is performed punctually in the area of the circumference of the opening 11.8. The pressure impact follows the pressure execution on the rear 12.8. As a result, projections aligned in conformity with the metal pin 4.8 form over the entire area of the circumference of the opening 11, said projections having critical influence on the pressure ratios in the opening 11 from the front 13.8 to the rear 12.8. In the presented case the projections 37.81, 37.82 arranged in circumferential direction to each other at equal distance are produced. The glass plug 6.8 can be here as a pressed piece.

Figure 9:
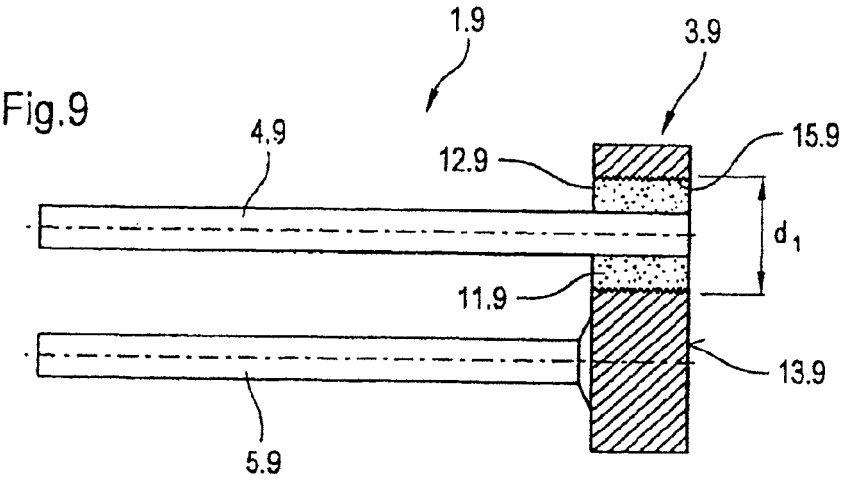
FIG. 9 illustrates an embodiment of the metal fixing material bushing designed as per the invention with surface texturing in the opening

FIG. 9 illustrates an implementation in which the inner circumference 15.9 of the opening 11.9 is characterized by an essentially constant mean diameter $d_1$ and additionally for achieving the holding effect for the glass plug 6.9, either the inner circumference 15.9 of the opening 11.9 in the base plate 3.9 or the outer circumference of the glass plug 6.9 undergoes surface treatment, in particular a surface machining processing, such as e.g. Sandblasting or staining. In the process roughness values in the area of $\mu \geqq 10$ μm are achieved. The roughening of the surface serves the purpose of fit and supports the strength. In the implementation shown in FIG. 9 preferably the entire inner circumference 15 of the opening 11.5 is subjected to a corresponding surface treatment. Further the possibility exists to restrict the surface treatment to only a sub-area, whereby this should extend at least in the area of the rear 12.9.

In addition it would be possible to have the glass plug which is inserted into the base plate to be additionally enclosed by a socket. Then both the surface of the opening and/or the socket and/or the metal pin can be roughened.

Figure 10:
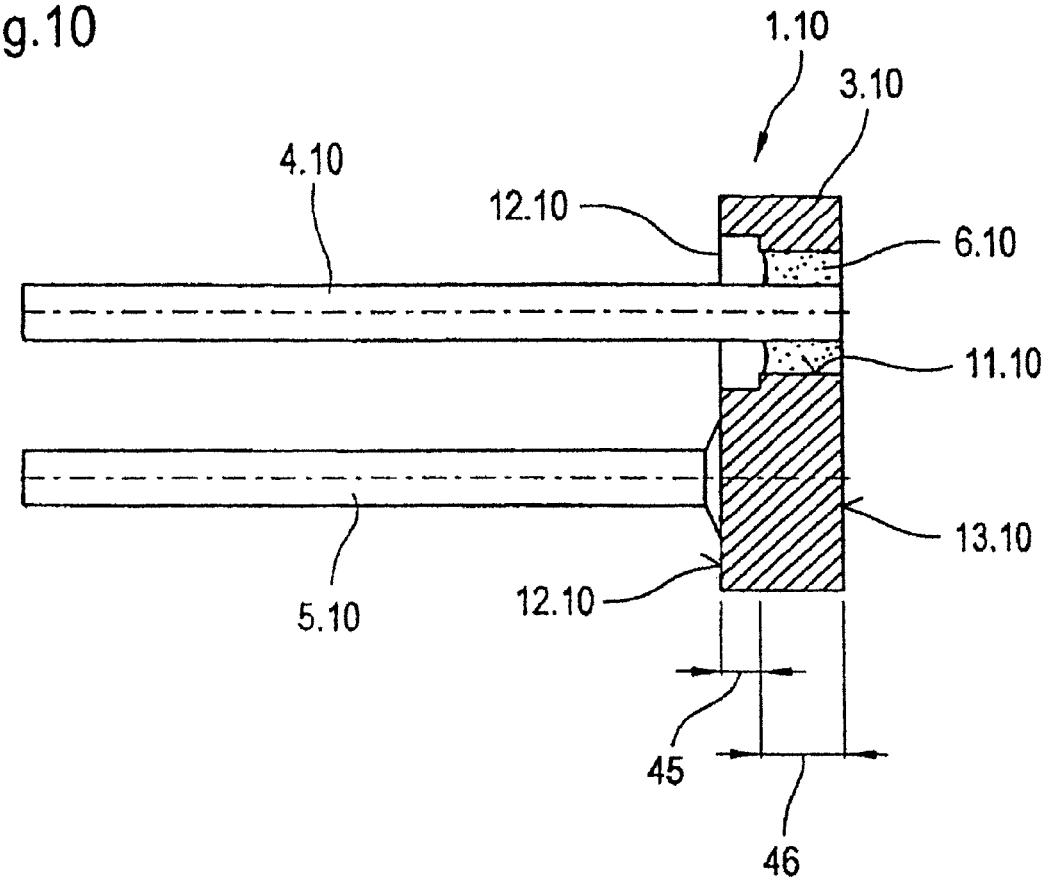
FIG. 10 illustrates a further alternative embodiment of the metal fixing material bushing designed as per the invention.

FIG. 10 illustrates a further alternative development. In this development the opening 11.10 is characterized by a greater diameter $d_2$ in the area of the rear 12.10 than on the front 13.10. This implementation makes it possible to design openings 11.10 also in thicker base plates 3.10. The opening 11.10 is for example punched or only bored out in sub-area 45. The second sub-area 46 is for example formed in both embodiments by boring this sub-area 46. In the bored sub-area 46 the glass plug 6.10 is inserted with the metal pin 4.10 and supported. Generally all of the possibilities named in the description for FIGS. 1 through 9 for inserting at least one opening in particular by means of punching out in a base plate are also suitable for inserting this opening in a first sub-area of the base plate and the rough working of the second sub-area for example by boring out of the base plate. The glass plug 6 with the metal pin can then be inserted into the first or second sub-area as described in FIGS. 1 through 9. While the previously described exemplified embodiments all referred to metal fixing material bushings, which comprised two metal pins, which were preferably in parallel arrangement, of which one of the metal pins was grounded to the rear of the base plate, the invention can in principle also be applied with more than two metal pins and with so-called mono pins. Mono pins are ignition units which comprise only a single metal pin, which is held by a pin support. The pin itself comprises for example a metal ring which forms the ground connection.

Figure 11:
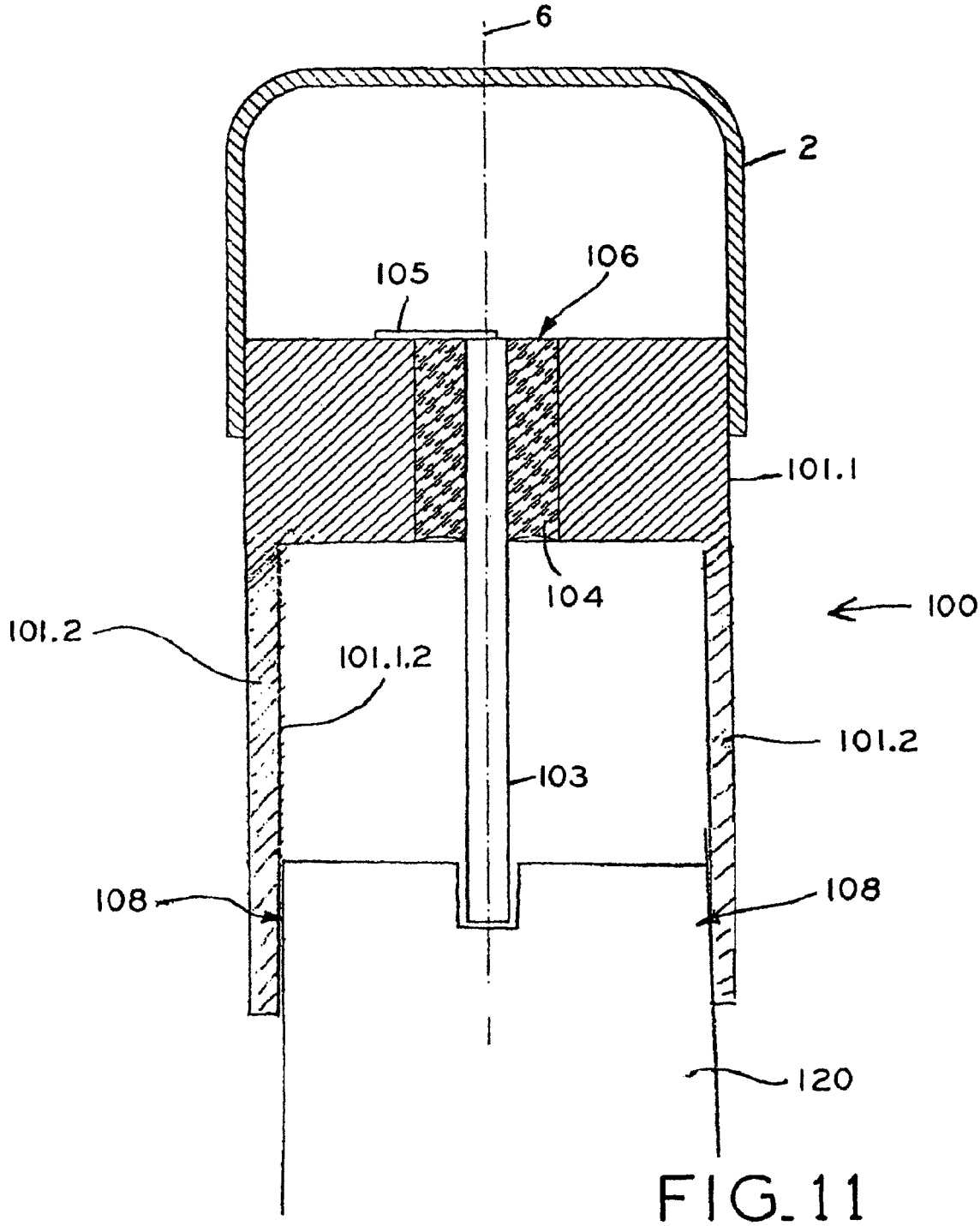
FIG. 11 illustrates an embodiment with a metal pin, a so-called mono-pin.

Such a mono pin is shown in FIG. 11. The pin support 100 comprises a metal pin 103, which is embedded in an insulated panel 104, which is preferably made of glass. The pin support comprises a base plate 101.1, which recesses the metal pin 103 as well as a socket with an inner wall panel 101.1.2. The end of the sealed part of the metal pin 103 is electrically connected to the base plate 101.1 by means of a bridge 105. The opening 106 is placed in the base plate for example by means of a punching step. The opening can be placed in the base plate as previously described in FIGS. 1 through 10. Together with the opening the base plate 101.1 can be punched out as previously described. Preferably the opening is punched out together with the base plate. Especially preferably the base plate forms a one-piece component with the socket 101.2. The manufacturing of a one-piece component can for example happen by having a punch part punched out in one procedure step and the socket can be obtained by means of deep drawing. Preferably the inner wall panel of the socket as well as the free end of the metal pin 103 is coated. Gold for example is used as a coating material. Preferably the coating is applied using electrolytic procedures. The coating serves the purpose of keeping the electrical resistance at the junction point 108 between a plug 120, which is inserted into the socket and of the interior 101.1.2 of the socket 101.2 low. The plug is designated as 120 in the figure.

Figure 12:
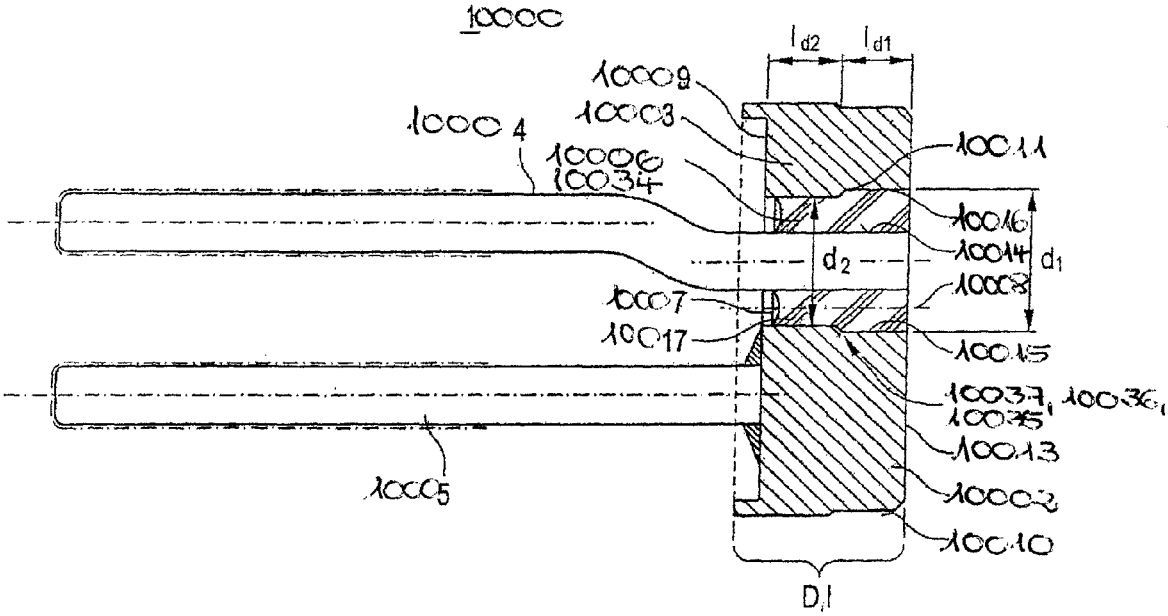
FIG. 12 illustrates a further embodiment of metal-sealing material-feedthrough in accordance with the current invention.

Referring now to FIG. 12, there is shown, with the assistance of an axial section, a further design of an inventively constructed metal-sealing material—feedthrough 10000, which can be used as an igniter or an ignition device of an airbag. This includes a base body 10003 forming a metal collar 10002 with which two parallel metal pins 10004 and 10005 are electrically connected. The two metal pins 10004 and 10005 are located parallel to each other. One of said metal pins functions as a conductor while the second one is grounded. In the illustrated example the first metal pin 10004 functions as conductor and the metal pin 10005 as grounding pin. At least one of the metal pins, especially the one metal pin 10004 functioning as conductor is inserted through the base body 10003. In this context the metal pin 10004 is sealed over a section of its length l in sealing material 10034, especially in a glass slug 10006 which is cooled from a molten glass mass. In the illustrated example the metal pin 10004 protrudes at least on one side from the face 10007 of the glass slug 10006 and, after completion of the fabrication process terminates flush with the second face 10008 of the glass slug 10006. In order to avoid dents in the area of the feedthrough opening 10011 during cooling of the sealing material which would lead to an undesirable weakening of the seal between the sealing material and the base body 10003 in the front area 10013, the metal pin 10004 is arranged in the feedthrough opening 10011 during the sealing process in such a manner that it protrudes beyond the base body 1003 and thereby beyond the front side 10013. Following sealing or encapsulation the metal pin 10004 and the protruding cooled sealing material may be ground so that it is flush with the front side 10013 and therefore also making the face 10008 of the glass slug 10006 flush with the front side 10013 of the base body 10003. Other variations are also feasible. In the illustrated example the ground pin 10005 is secured directly onto the back side 10012 of the base body 10003. The base body 10003 is designed as a punched component. A punched component in accordance with the current application is one wherein at least one feedthrough opening 10011, and possibly also the end geometry of the base body 10003, is produced by punching. In accordance with an advanced design the geometry describing the outer contour, especially the outside circumference 10010 may be produced through cut-out, such as through punching. The punched component can subsequently be used either in the form it embodies after the punching process or it can be reshaped, for example stamped or deep-drawn in an additional immediately following process.

The feedthrough opening 10011 which serves to retain and seal the metal pin 10004 by way of the glass slug 10006 is produced by a punching process in the form of a hole. Subsequently the metal pin 10004 is inserted into the feedthrough opening 10011 at the back side 10012 of the metal-sealing material-feedthrough 10001, together with the glass slug. The metal body containing the glass slug 10006 and the metal pin is heated so that the metal shrinks after a cooling process, thereby producing a frictional connection between the glass slug 10006 with the metal pin 10004 and the base body 10003.

It is also feasible to bring the sealing material 10034 in its molten or free flowing condition, especially the molten glass from the front side 10013 into the feedthrough opening 10011. During cooling a positive fit or material seal is created between the outside circumference 10014 of the metal pin 10004, as well as the inside circumference 10015 of the feedthrough opening 10011. In accordance with the current invention the base body 10003 is designed such that the ratio between the thickness D of the base body 10003 and the maximum possible dimension of the feedthrough opening 10011 vertical to the direction of the axis of the feedthrough opening 10011 is in the range of between and including 0.5 to 2.5. Depending upon the design of the feedthrough opening 10011 which may for example be characterized by a circular cross section or an oval cross section, the maximum possible dimension is determined by the diameter d or the length of the oval. The axial direction is consistent with the geometric axis, especially the axis of symmetry of the feedthrough opening 10011 and extends through the base body 10003. If the base body 10003 is in the embodiment of a punched component, it is preferable in order to produce an especially compact, cost efficient and energy efficient base body 10003 including the desired characteristic, especially the desired force of ejection when triggering the ignition, that the ratio between the thickness D of the base body 10003 and the maximum possible dimension of the feedthrough opening 10011 vertical to the direction of the axis of the feedthrough opening 10011 is selected in a range of between and including 0.8 to 1.6, preferably 0.8 to 1.4, especially preferably 0.9 to 1.3, more especially preferably 1.0 to 1.2. Specifically expressed in dimensions this means that for example, the thickness D of the base body 10003 is between 1 and 5 mm, preferably 1.5 mm and 3.5 mm, especially preferably 1.8 mm to 3.0 mm, more especially preferably 2.0 to 2.6 mm. Compared to pivoted components a substantially smaller construction is realized and in addition, the cross section of the feedthrough opening 11 may be selected as desired, depending upon requirement.

Table 1 and Table 2 of FIGS. 13 and 14 list the absolute values of a circular hole diameter, in other words the diameter of the feedthrough opening as well as the thickness of the base body which contains the feedthrough opening, as well as the resulting ratio between thickness and hole diameter. Table 1, according to FIG. 13, lists the values of the hole diameter relative to the values of the thickness of the base body after the grinding process. Through the grinding process which, as previously described, serves to grind protruding parts of the glass slug, the thickness of the entire body is reduced by approximately 0.4 mm. The hole diameter is stated in mm in Table 1. According to Table 1, the hole diameters range from 1.6 mm to 3.5 mm. In addition, the thicknesses of the base body after grinding are stated in mm. The thicknesses of the base body after grinding range from 2.0 to 3.0 mm. The resulting ratios of thickness to hole diameter are also listed. The framed section 11000 indicates the preferred range of the diameters as well as the ratios of thickness to hole diameter. Section 11100 shows the especially preferred range.

Table 2 of FIG. 14 shows the thickness of the base body after punching, however before the grinding process, in mm, as well as the hole diameter in mm. In addition, the ratio of thickness to hole diameter is also listed. Again, the preferred ranges are indicated by 11000 and the especially preferred ranges by 11100.

In order to avoid loosening of the metal pin 4 with the glass slug 6 from the base body 3 during the stress associated with ignition, even with the smaller support surface resulting from the shortening of the feedthrough opening 10011, a way to prevent a relative movement between sealing material 10034 and inside circumference 10015 of the feedthrough opening in the direction of the backside 10012 is provided and is identified here by 10035.

These function as barbs and under the effects of tensile force and/or pressure upon the glass slug 10006 and/or the metal pin 10004 lead to a positive fit between the base body 10003 and the glass slug 10006 and thereby prevent sliding out on the back side 10012. The feedthrough opening can be designed such that it has an undercut 10036 which is formed by a protrusion 10037. This is located in the area of the back side 10012 and in the illustrated example, has a positive fit with it. The feedthrough opening 10011, which, in the illustrated example, can possess a circular cross section, is characterized by this protrusion 10037 through two different diameters $d_1$ and $d_2$. Diameter $d_1$ is larger than diameter $d_2$. Diameter $d_2$ is the diameter of the feedthrough opening 10011 on the back side 10012. Diameter $d_1$ is the diameter of the feedthrough opening 10011 on the front side 10013. However, the feedthrough opening 10011 is constructed as having a constant diameter $d_1$ along a substantial section of its extension $l_{d1}$. $l_{d2}$ designates the feedthrough opening 10011 with the diameter $d_2$. This means that the feedthrough opening has two partial segments, a first partial segment 10016 and a second partial section 10017, wherein the first partial segment 10016 is characterized by the diameter $d_1$ and the second partial segment 10017 by the diameter $d_2$. These diameters are produced by a one-sided punching process in the form of hole-punching from the front side 10013 or the back side 10012 with a subsequent forming process under the influence of pressure, especially stamping. The punching and forming process can occur from the same side—in the illustrated example from the front side 10013. Punching out of the base body 10003 can occur also within the scope of the punching process for the feedthrough opening 10011, in other words during the same process step. The tool for this is formulated such that the entire base body 10003 including a feedthrough opening 10011 is punched in one process step from a sheet metal having a certain sheet thickness b which is consistent with a thickness D of the base body 10003. In accordance with the present invention, the above referenced ratios between the thickness D of the base body 10003 and the dimension of the feedthrough opening 10011 are adhered to in order to achieve a high tensile force, ejection force, and/or extraction force at a reduced thickness when compared to pivoted components, thereby achieving an especially cost effective and material effective fabrication. By merely providing an undercut 10036 the tensile force, ejection force, and/or extraction force can be almost doubled. According to the invention the undercut 10036 and thereby the protrusion 10037 is configured such that a cross sectional reduction in the partial section 10017 occurs which is characterized by a reduction in diameter, in other words the difference $\Delta d=d_1-d_2$, or a reduction of the maximum dimension in the range if 0.05 to 1 mm, in the range of 0.08 to 0.9 mm, preferably 0.1 to 0.3 mm. The difference $\Delta=d_1-d_2$ in diameter which leads to the undercut 10036 and the protrusion 10037 is sufficient to compensate for the shorter construction and thereby the shorter length of the feedthrough opening in a punched component when compared with a pivoted component, wherein in addition the ejection force is also increased.

Materials for the base body can be metals, especially standard steel such as St 35, St 37, St 38 or special steel or stainless steel types. Stainless steel according to DIN EN 10020 is a designation for alloyed and unalloyed steels whose sulfur and phosphor content (so-called companion elements to iron) does not exceed 0.035%. Additional heat treatments (for example tempering) are often provided subsequently. Special steels include for example high purity steels wherein components such as aluminum and silicon are eliminated from the molten mass in a special manufacturing process. They also include high alloy tool steels which are intended for later heat treatment. The following are examples of what may be utilized: X12CrMoS17, X5CrNi1810, XCrNiS189, X2CrNi1911, X12CrNi177, X5CrNiMo17-12-2, X6CrNiMoTi17-12-2, X6CrNiTi1810 and X15CrNiSi25-20, X10CrNi1808, X2CrNiMo17-12-2, X6CrNiMoTi17-12-2.

The advantage of the aforementioned materials, especially the cited tool steels, is that when using these materials a high corrosion resistance, a high mechanical rigidity as well as excellent weldability is assured.

In the arrangement depicted in FIG. 12 the feedthrough opening 10011 has a circular cross section. However, other forms are also feasible wherein in this instance an undercut is formed by changing the inside dimensions of the opening. In addition the illustrated geometries are reproduced in an idealized manner. In practice, surface areas will occur as a rule which is not positioned at true right angle with each other. It is critical that a fundamental profile is created for the feedthrough opening which, on the one hand, meets the challenge of holding a sealed-in metal pin and also of avoiding coming out of the entity of metal pin and sealing material, especially glass slug. This means that also the surface areas which form the undercut and the adjacent surface areas may be located at an angle with each other.

Figure 15:
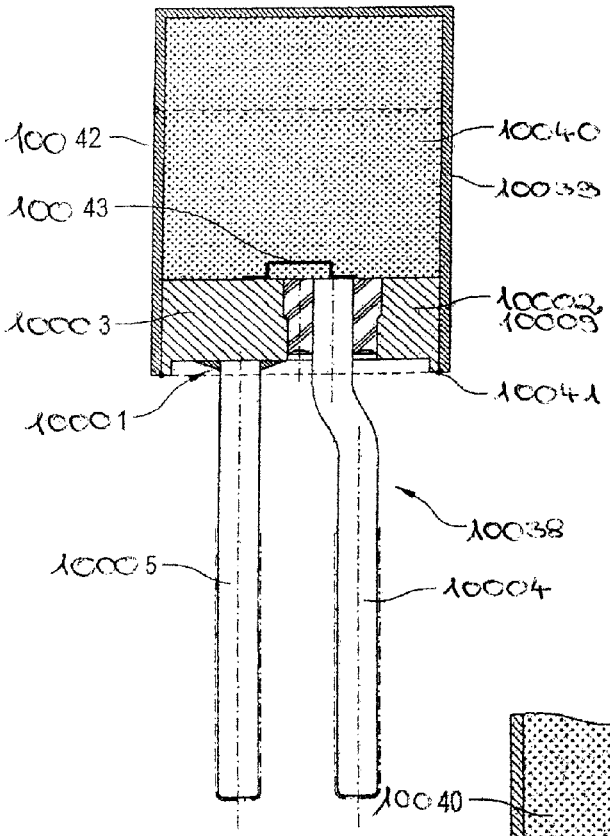
FIG. 15 illustrates an embodiment of an ignition device in accordance with the current invention, including a metal-sealing material feedthrough according to FIG. 13.

FIG. 15 illustrates in a greatly simplified depiction an example of an axial section through an ignition device 10038 including a metal-sealing material-feedthrough 10001, as shown in FIG. 12 through 14. The ignition device 10038 is produced by utilizing such a feedthrough by sealing of a cap 10039 with the base body 10003 thereby encasing a propellant 10040, wherein the seal occurs for example through a continuous laser weld seam 10041 along the welded edge. This produces a hermetically sealed housing 10042 for the propellant. FIG. 15 also depicts a bridge 10043 which is connected to the metal pin 10004 of the current-feedthrough and the cap 10039, or the base body 10003 before or during connection of the metal-sealing material feedthrough 10001 and cap 10039. The ignition bridge 10043 may for example be in the form of a filament which is attached to the base body through spot welding. In contrast to the highly simplified illustration in FIG. 15 an advance-propellant is used in addition to the propellant 10040 which surrounds the ignition bridge 10042.

Figure 16:
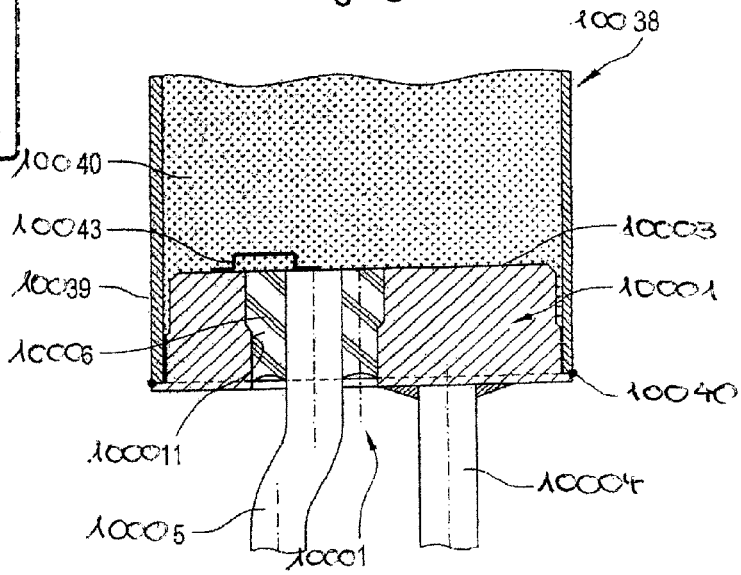
FIG. 16 illustrates a section of a cross section of an additional design form of an ignition device.

FIG. 16 is a sectional view of a cross section through an additional embodiment in an application of an inventive metal-sealing material-feedthrough 10001 in an ignition device 10038. In this arrangement the welded edge of the base body 10003 does not extend in axial direction as in the example illustrated in FIG. 15. It extends in radial direction of the base body 1003 and continuous in circumferential direction around it. The welded edge forms a stop 10044 when placing the cap 10039, so that precise positioning of said cap is very easy. The welded edge can be obtained in an advantageous manner by deep-drawing or extruding of a punched base body 10003.

Figure 17:
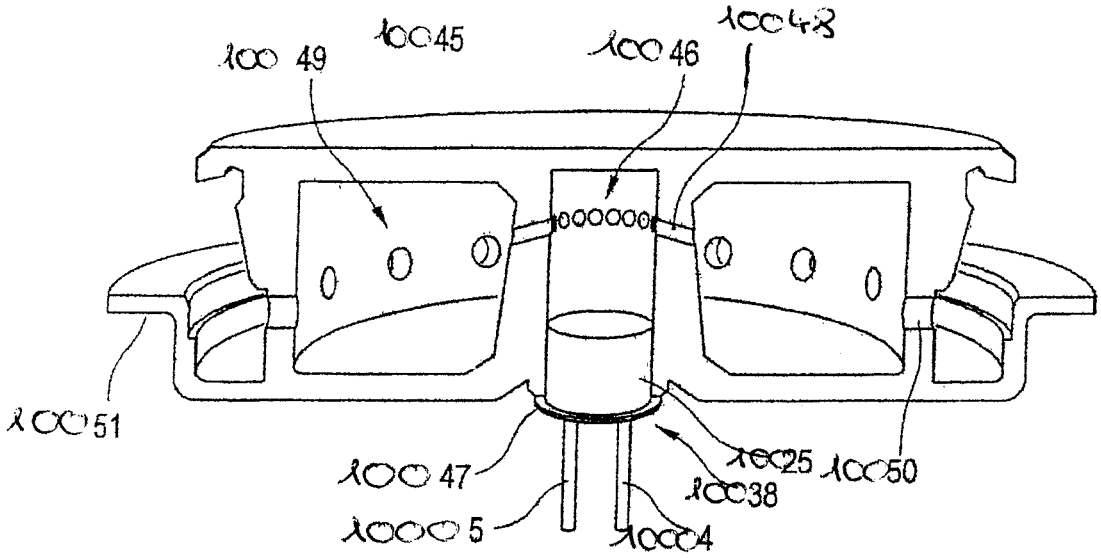
FIG. 17 illustrates an example of a possible application of a metal-sealing material-feedthrough in accordance with the current invention, in an ignition device in a gas generator.
Figure 18:
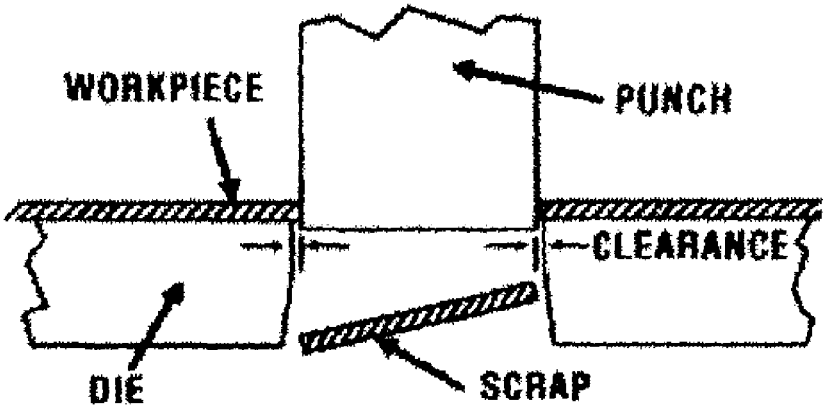
FIG. 18 illustrates a two dimensional 1002 at a typical punching process.

FIG. 17 illustrates a sectional depiction of a gas generator 10045 of a pyrotechnical protective device including an ignition device 10038 which is not depicted as a sectional view in FIG. 17. The gas generator 10045 may be used especially for a steering wheel airbag. For this purpose it is installed in the impact absorber of the steering wheel. The ignition device 10038 is located in a centrally located hollow space 10046 of the gas generator 10045. The ignition device 10038 is equipped for example with a flange 10047 for mounting at the opening of the central hollow space 10046. The central hollow space 10046 is connected via channels 10048 with a ring shaped propellant container 10049 which contains the propellant, for example sodium azide, potassium nitrate and sand pressed into tablet form. During the ignition process said propellant is ignited by the gas which escapes explosively from the ignition device 10038 and in turn releases propellant gases which flow to the outside through the channels 10050 and inflate an airbag which is attached, for example on the mounting ring 10051.

In all design examples illustrated at least the feedthrough opening, or the entire base body, can be punched components. The individual measures taken in order to avoid a separation of the metal pin 10004 from the base body under load which are depicted in the individual drawings on the base body 10003, as well as the measures taken to avoid pulling the metal pin from the sealing material as provided on the metal pin, may also be applied together in combination. There are no limitations on the design in this regard. However, designs are strived for which assure great strength of the entire connection between the metal pin 10004 and the base body 10003 and thereby the metal-sealing material-feedthrough 10001. In all designs depicted in the drawings the feedthrough openings may be designed as having different cross sectional profiles, including circular cross sections. The formation of the undercuts occurs as an integral component of the base body. In an embodiment the invention provides the ratio the thickness of the punched component in relation to the hole diameter for fabricating a metal-sealing material-feedthrough as a punched component, and especially the feedthrough opening by way of punching.

The invention claimed is:

1. A method for manufacturing an igniter for air bags or belt tensioning pulleys, comprising:

stamping or punching from a metal sheet a base plate having a thickness of between 1.5 and 3.5 mm and a final outer geometry;

punching or stamping in the base plate an opening extending therethrough, said opening having at least one retention structure forming an undercut, said opening having a maximum diameter in a range of between and including 1.8 to 4 mm;

inserting a metal pin and a plug of fixing material into the opening wherein the pin is disposed within the fixing material and protrudes beyond a rear surface of the base plate, a portion of the fixing material being mechanically retained by the undercut to prevent movement of the fixing material plug relative to the base plate in a direction toward the rear surface of the base plate.

2. The method of claim 1, wherein the fixing material plug is glass.

3. The method of claim 1, wherein the fixing material plug is inserted into the opening in the form of molten fixing material and then cools to form a connection with the base plate opening and the metal pin.

4. The method of claim 1, wherein an outer geometry of the base plate is produced by a punching operation and the geometry of the opening is produced by a stamping operation.

5. The method according to claim 4, wherein the stamping and punching operations are performed from the same side on the base plate.

6. The method according to claim 4, wherein the stamping and punching operations are performed at different sides on the base plate.

7. The method of claim 1, wherein the undercut is formed as a taper extending from a front surface of the base plate to the rear surface thereof, the taper having a diameter that decreases steadily from the front surface to the rear surface.

8. The method according to claim 1, wherein the final outer geometry produced by the stamping or punching process and the geometry describing a starting form of the opening are produced in one processing step comprising punching out with a tool.

9. The method according to claim 1, wherein the undercut in the opening is formed by deformation of the opening.

10. The method according to claim 9, wherein the deformation is achieved by means of at least one stamping operation.

11. The method according to claim 9, wherein the stamping or punching operation is performed on both sides of the base plate.

12. The method according to claim 1, wherein after punching out of the opening on the sheet metal part a stamping operation is performed.

13. A method for manufacturing an igniter for air bags or belt tensioning pulleys, comprising:

stamping or punching from a metal sheet a base plate having a final outer geometry;

punching in the base plate an opening extending therethrough, said opening having at least one retention structure forming an undercut;

inserting a metal pin and a plug of fixing material into the opening wherein the pin is disposed within the fixing material and protrudes beyond a rear surface of the base plate, a portion of the fixing material being mechanically retained by the undercut to prevent movement of the fixing material plug relative to the base plate in a direction toward the rear surface of the base plate; and providing an ignition bridge extending between and electrically connecting said in and said base plate, said ignition bridge being positioned on a side of said base plate which is opposite from said protruding portion of said metal pin;

wherein the base plate is configured such that a ratio of a thickness of the base plate to a maximum dimension of the opening vertical to an axis direction of the opening is in a range of between and including approximately 0.8 to 1.6, the thickness of the base plate being between 1.8 mm and 3.0 mm.

14. A method for manufacturing an igniter for air bags or belt tensioning pulleys, comprising:

stamping or punching from a metal sheet a base plate having a thickness of between 1.5 and 3.5 mm and a final outer geometry;

punching in the base plate an opening extending therethrough, said opening having at least one retention structure forming an undercut, said opening having a maximum diameter in a range of between and including 1.4 to 4 mm;

inserting a metal pin and a plug of fixing material into the opening wherein the pin is disposed within the fixing material and protrudes beyond a rear surface of the base plate, a portion of the fixing material being mechanically retained by the undercut to prevent movement of the fixing material plug relative to the base plate in a direction toward the rear surface of the base plate; and providing an ignition bridge extending between and electrically connecting said pin and said base plate, said ignition bridge being positioned on a side of said base plate which is opposite from said protruding portion of said metal pin.

* * * * *

UNITED STATES PATENT AND TRADEMARK OFFICE

CERTIFICATE OF CORRECTION

PATENT NO. : 8,276,514 B2
APPLICATION NO. : 12/788624
DATED : October 2, 2012
INVENTOR(S) : Thomas Fink et al.

It is certified that error appears in the above-identified patent and that said Letters Patent is hereby corrected as shown below:

In the Claims

COLUMN 22

At line 30, in claim 13, please delete "said in", and replace it therefore with --said pin--.

Signed and Sealed this
Twenty-fourth Day of September, 2013

Teresa Stanek Rea
*Deputy Director of the United States Patent and Trademark Office*